US008882456B2

(12) United States Patent
Lanese et al.

(10) Patent No.: US 8,882,456 B2
(45) Date of Patent: Nov. 11, 2014

(54) AIRFOIL SHAPE FOR COMPRESSOR

(75) Inventors: Nicola Lanese, Florence (IT); Salvatore Lorusso, Florence (IT); Paolo Arinci, Florence (IT); Antonio Maria Grimaldi, Florence (IT)

(73) Assignee: Nuovo Pignone S.p.A., Florence (IT)

( * ) Notice: Subject to any disclaimer, the term of this patent is extended or adjusted under 35 U.S.C. 154(b) by 387 days.

(21) Appl. No.: 13/218,106

(22) Filed: Aug. 25, 2011

(65) Prior Publication Data

US 2012/0051901 A1 Mar. 1, 2012

(30) Foreign Application Priority Data

Aug. 25, 2010 (IT) ..... CO2010A000045

(51) Int. Cl.
*F01D 5/16* (2006.01)
*F04D 29/32* (2006.01)
*F01D 5/14* (2006.01)

(52) U.S. Cl.
CPC ..... *F01D 5/141* (2013.01); *F04D 29/324* (2013.01); *F05D 2250/74* (2013.01); *F05D 2260/96* (2013.01); *Y10S 416/02* (2013.01)
USPC ..... 415/193; 416/223 A; 416/DIG. 2

(58) Field of Classification Search
USPC ..... 415/191, 192, 208.1, 208.2; 416/223 A, 416/243 A, DIG. 2, DIG. 5, 223 R, 243
See application file for complete search history.

(56) References Cited

U.S. PATENT DOCUMENTS

| | | | | |
|---|---|---|---|---|
| 4,652,213 | A * | 3/1987 | Thibert et al. | 416/223 R |
| 5,980,209 | A | 11/1999 | Barry et al. | |
| 6,257,828 | B1 * | 7/2001 | Bischoff-Beiermann et al. | 415/200 |
| 6,761,535 | B1 * | 7/2004 | McGrath et al. | 416/243 |
| 7,530,794 | B2 * | 5/2009 | Sassanelli et al. | 416/243 |
| 7,572,105 | B2 | 8/2009 | Columbus et al. | |
| 2007/0201983 | A1 | 8/2007 | Arinci et al. | |
| 2009/0290987 | A1 * | 11/2009 | Parker et al. | 416/223 R |
| 2010/0008784 | A1 * | 1/2010 | Shafique et al. | 416/223 R |
| 2010/0040475 | A1 * | 2/2010 | Boquet et al. | 416/223 R |
| 2011/0116917 | A1 * | 5/2011 | Wang et al. | 415/208.1 |

FOREIGN PATENT DOCUMENTS

| | | |
|---|---|---|
| EP | 1754859 A2 | 2/2007 |
| EP | 1921257 A2 | 5/2008 |

OTHER PUBLICATIONS

Italian Search Report and Written Opinion issued in connection with IT Application No. CO20100045, Mar. 22, 2011.
EP Search Report and Opinion dated May 13, 2014 from corresponding EP Application No. 11178245.4.

* cited by examiner

*Primary Examiner* — Edward Look
*Assistant Examiner* — Liam McDowell
(74) *Attorney, Agent, or Firm* — GE Global Patent Operation

(57) ABSTRACT

A rotor blade is disclosed herein. The rotor blade comprises a nominal surface profile substantially in accordance with Cartesian coordinates X, Y and Z as set forth in TABLE 1. Wherein X and Y are distances in millimeters which, when connected by smooth, continuing arcs, define airfoil profile sections at each distance Z in millimeters. The airfoil profile sections at the Z distances being joined smoothly with one another to form a complete airfoil shape.

14 Claims, 5 Drawing Sheets

AIRFOIL SHAPE FOR COMPRESSOR

BACKGROUND OF THE INVENTION

1. Field of the Invention

The present invention relates generally to airfoils and, more specifically, to airfoil shapes used in compressors, e.g., as part of gas turbines.

2. Description of Related Art

A compressor is a machine which accelerates gas particles to, ultimately, increase the pressure of a compressible fluid, e.g., a gas, through the use of mechanical energy. Compressors are used in a number of different applications, including operating as an initial stage of a gas turbine engine. Among the various types of compressors are the so-called centrifugal compressors, in which mechanical energy operates on gas input to the compressor by way of centrifugal acceleration, e.g., by rotating a centrifugal impeller (sometimes also called a "rotor") by which the compressible fluid is passing, and axial compressors which have, as each stage, a drum having a number of annular airfoil rows (blades) attached thereto. The airfoils attached to the drum rotate between a similar number of stationary airfoil rows attached to a stationary casing. More generally, axial and centrifugal compressors can be said to be part of a class of machinery known as "turbo machines" or "turbo rotating machines".

In a gas turbine engine, many system requirements should be met at each stage of a gas turbine's flow path section to meet design goals. These design goals include, but are not limited to, overall improved efficiency and airfoil loading capability. For example, and in no way limiting of the invention, a blade of a compressor stator should achieve thermal and mechanical operating requirements associated with the particular stage in which it is located. Similarly, and also as a purely illustrative example, a blade of a compressor rotor should also achieve thermal and mechanical operating requirements associated with the particular stage of the gas turbine in which it is located.

In particular, it would be desirable to ensure that the surfaces of such blades are shaped so that their resonance frequencies are tuned to accommodate operating characteristics of the turbo machines as a whole.

BRIEF SUMMARY OF THE INVENTION

Devices, systems and methods according to embodiments of the invention provide blades, e.g., as part of a rotor or a stator associated with a turbo machine, with particular shapes to optimize operating characteristics. Among other things, blade thickness as a function of blade height can be tailored to operating characteristics of the turbo machine.

According to an embodiment of the invention, a rotor blade comprising a nominal surface profile substantially in accordance with Cartesian coordinates X, Y and Z as set forth in TABLE 1, wherein X and Y are distances in millimeters which, when connected by smooth, continuing arcs, define airfoil profile sections at each distance Z in millimeters, and wherein the airfoil profile sections at the Z distances being joined smoothly with one another to form a complete airfoil shape.

According to another embodiment of the invention, a rotor blade comprising a platform, a root portion of the rotor blade connected to the platform, and a blade surface ending in a tip portion, the blade surface comprising a cross-sectional airfoil shape, wherein a thickness of the rotor blade varies as a function of rotor blade height in accordance with three different linear functions.

According to yet another embodiment of the invention, a turbo machine comprising a drive shaft, at least one rotor wheel, a plurality of circumferentially spaced rotor blades mounted on the rotor wheel, a stator, and a plurality of circumferentially spaced stator blades attached to the stator wherein at least one of the plurality of rotor blades and plurality of stator blades further includes: a platform, a root portion of the at least one of the plurality of rotor blades and plurality of stator blades connected to the platform, and a blade surface ending in a tip portion, the blade surface comprising a cross-sectional airfoil shape, wherein a thickness of the at least one of the plurality of rotor blades and plurality of stator blades varies as a function of blade height in accordance with three different linear functions.

BRIEF DESCRIPTION OF THE SEVERAL VIEWS OF THE DRAWINGS

The accompanying drawings illustrate embodiments of the invention, wherein.

DETAILED DESCRIPTION OF THE INVENTION

The following detailed description of the embodiments of the invention refers to the accompanying drawings. The same reference numbers in different drawings identify the same or similar elements. Also, the following detailed description does not limit the invention. Instead, the scope of the invention is defined by the appended claims.

To provide some context for the subsequent discussion relating to airfoil shapes according to the embodiments of the invention, a brief discussion associated with axial compressors is first provided. In an axial compressor, rotor blades impart kinetic energy to the air flow and therefore bring about a desired pressure rise across the compressor. Directly following the rotor airfoils is a stage of stator airfoils. Both the rotor and stator airfoils turn the airflow, slow the airflow velocity (in the respective airfoil frame of reference), and yield a rise in the static pressure of the airflow.

The configuration of the airfoils (along with their interaction with surrounding airfoils), including, for example, their peripheral surface (profile) determines stage airflow efficiency, aeromechanics, smooth laminar flow from stage to stage, reduced thermal stresses, enhanced interrelation of the stages to effectively pass the airflow from stage to stage, and reduced mechanical stresses, among other desirable aspects of these embodiments of the invention. Typically, multiple rows of rotor/stator stages are stacked in axial flow compressors to achieve a desired discharge to inlet pressure ratio. Rotor and stator airfoils can be secured to rotor wheels or stator case by an appropriate attachment configuration, often known as a "root", "base" or "dovetail", examples of which are described below.

Figure 1:
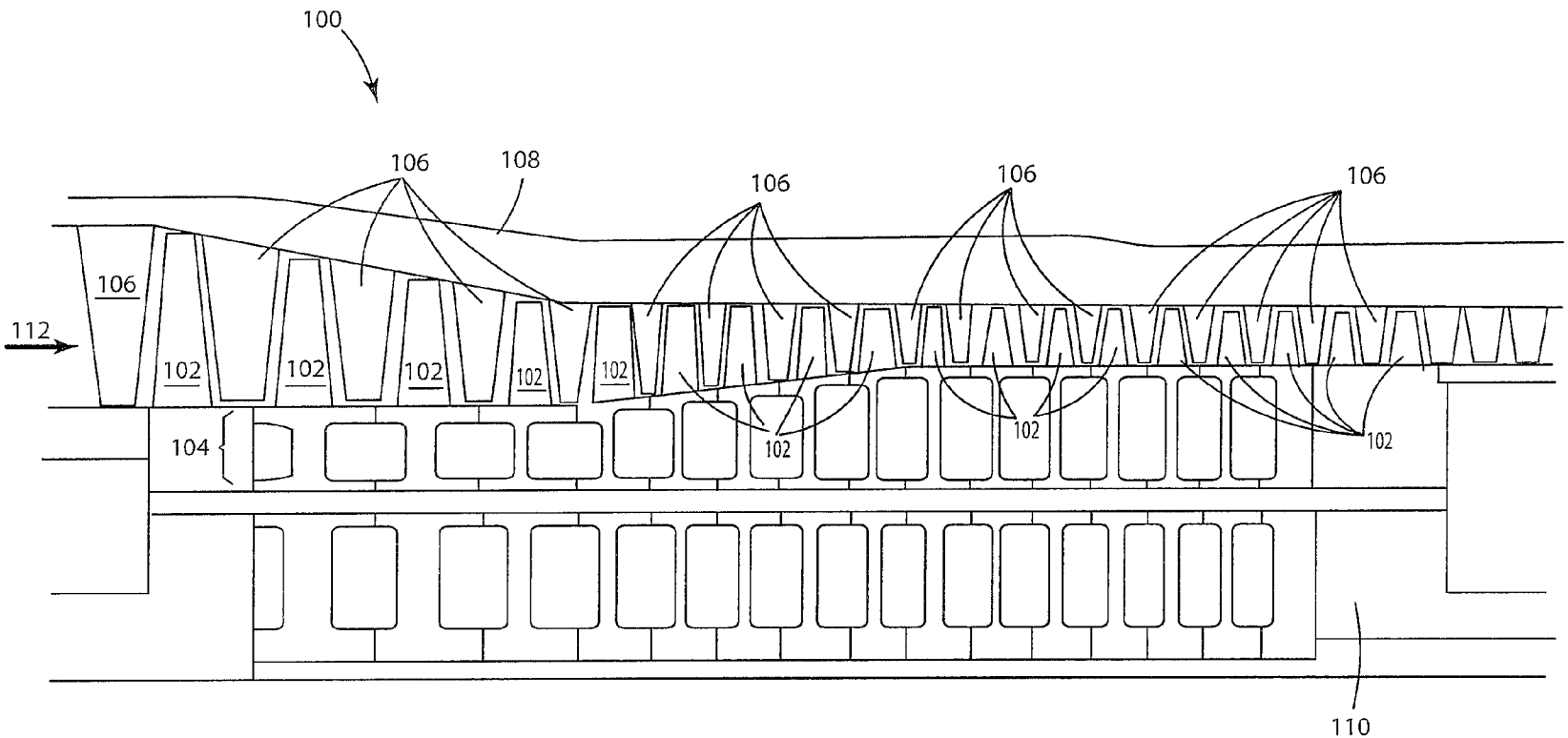
FIG. 1 depicts an exemplary axial compressor in which blade shapes according to embodiments of the invention can be implemented.

FIG. 1 illustrates an axial compressor 100, e.g., associated with a gas turbine compressor in accordance with an embodiment of the invention. As mentioned above, an axial compressor typically includes a plurality of compressor stages, for example seventeen or eighteen stages, however those skilled in the art will appreciate that axial compressors according to embodiments of the invention may include any number of rotor stages and stator stages. The stage 100 of the axial compressor illustrated in FIG. 1 includes a plurality of circumferentially spaced rotor blades 102 mounted on a rotor wheel or drum 104 and a plurality of circumferentially spaced stator blades 106 attached to a static compressor case 108.

Each of the rotor wheels 104 is attached to aft drive shaft 110, which is connected to the turbine section (not shown) of the engine. The rotor blades 102 and stator blades 106 are disposed in the flow path of the axial compressor. The direction of airflow along the flow path, in this exemplary axial compressor, is indicated by the arrow 112. It will be appreciated that this stage 100 of an axial compressor is merely exemplary of the various stages of an axial compressor and that the illustrated and described stage 100 of the axial compressor is not intended to limit the invention in any manner.

Figure 2:
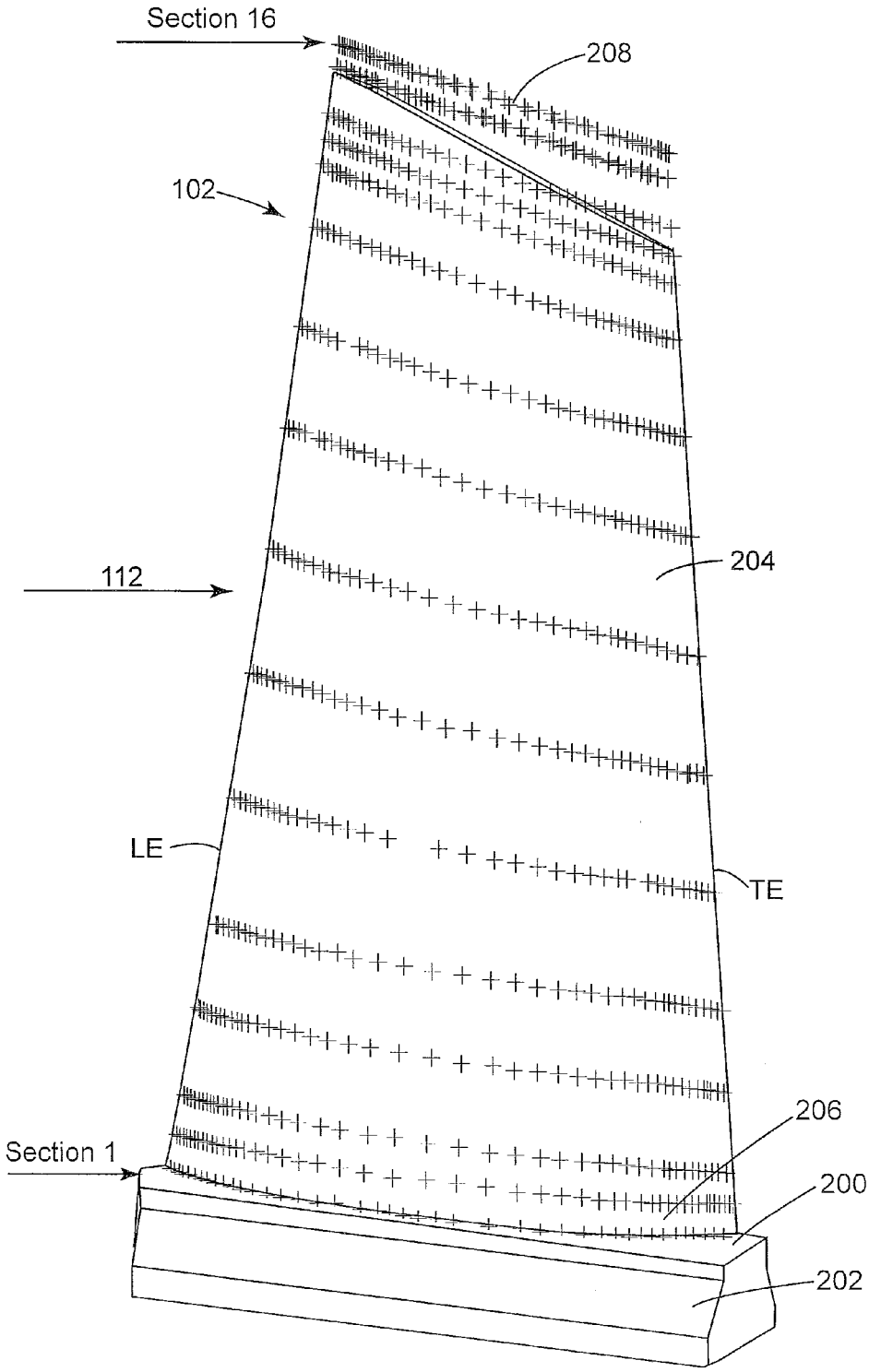
FIG. 2 shows a suction side of a rotor blade according to an embodiment of the invention.
Figure 3:
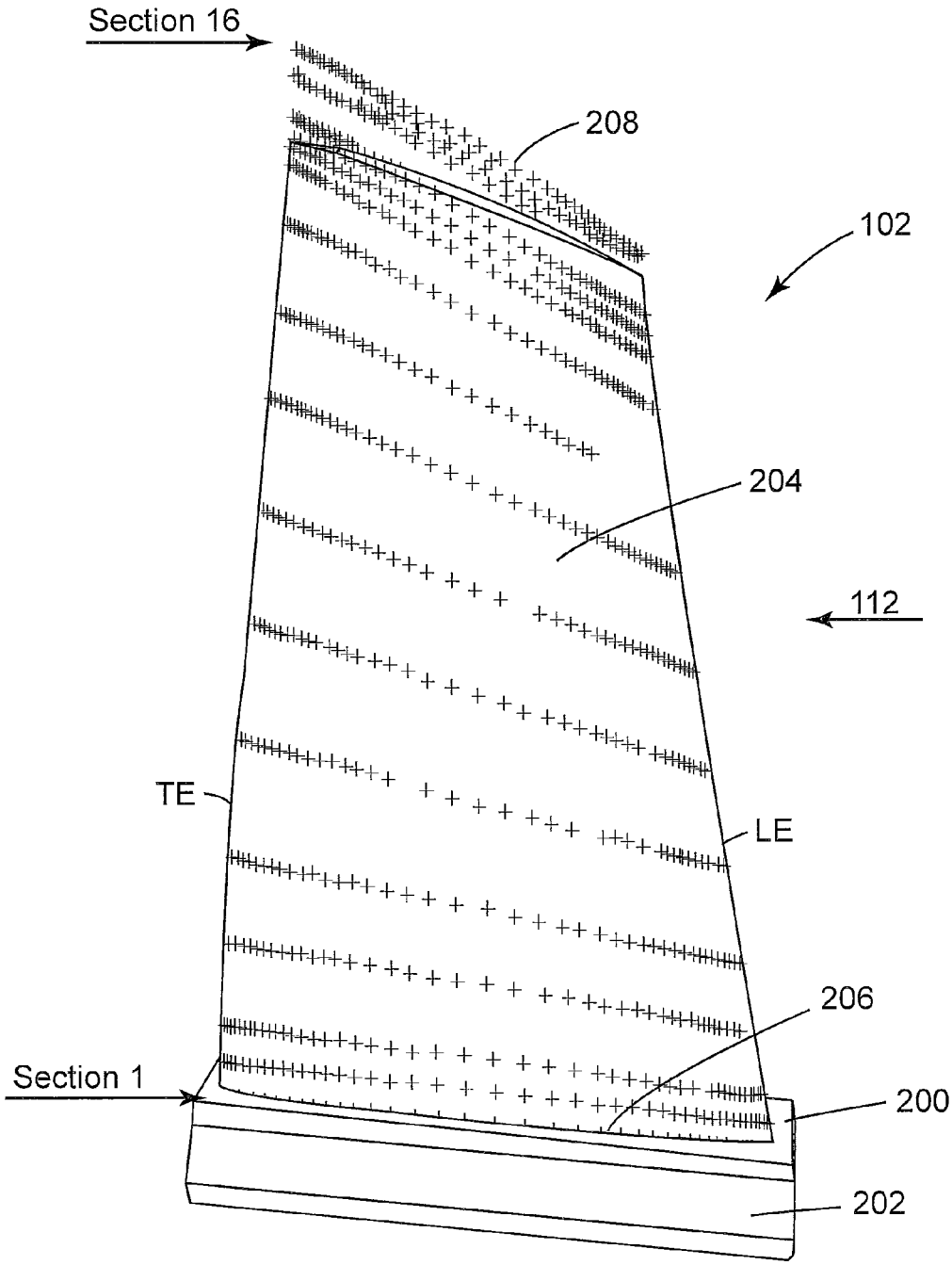
FIG. 3 shows a pressure side of a rotor blade according to an embodiment of the invention.

Rotor blades 102 according to embodiments of the invention are illustrated in more detail in FIGS. 2 and 3 which show opposite sides of a rotor blade 102. In particular, but without limiting the invention, such rotor blades 102 according to these embodiments of the invention can be used in the first stage of axial compressors like that shown in FIG. 1, i.e., in the stage closest to the inlet associated with the process flow. Specifically, FIG. 2 depicts the suction side of a rotor blade 102 according to an embodiment of the invention, while FIG. 3 depicts the pressure side of the same rotor blade 102 having a leading edge (LE) and trailing edge (TE) as shown relative to the compressor flow path 112. Each rotor blade 102 can, for example, be provided with a platform 200, and a substantially axial (or near axial) entry dovetail 202 for connection with a complementary-shaped mating dovetail (not shown) on the rotor wheel 104. Additionally, each rotor blade 102 includes a rotor blade airfoil 204 having a profile at any cross-section thereof, i.e., from the airfoil root 206 to the rotor blade tip 208 in the general shape of an airfoil, as will be discussed in more detail below.

To define the airfoil shape of the rotor blade airfoil 204 according to embodiments of the invention, a set or loci of points in space are provided in Table 1 below. It can be seen that the exemplary rotor blade 102 in FIGS. 2 and 3 have sixteen section lines, although those skilled in the art will recognize that any number of sections could be defined. This set or loci of points is intended to meet the section requirements associated with the section or sections in which rotor blades 102 are to be used so that the section can be manufactured. This loci of points is also intended to meet the desired specifications for stage efficiency and reduced thermal and mechanical stresses. The loci of points are arrived at by simulations, iterating between aerodynamic and mechanical loadings and enabling compressors designed in accordance with embodiments of the invention to run in an efficient, safe and smooth manner.

Figure 4:
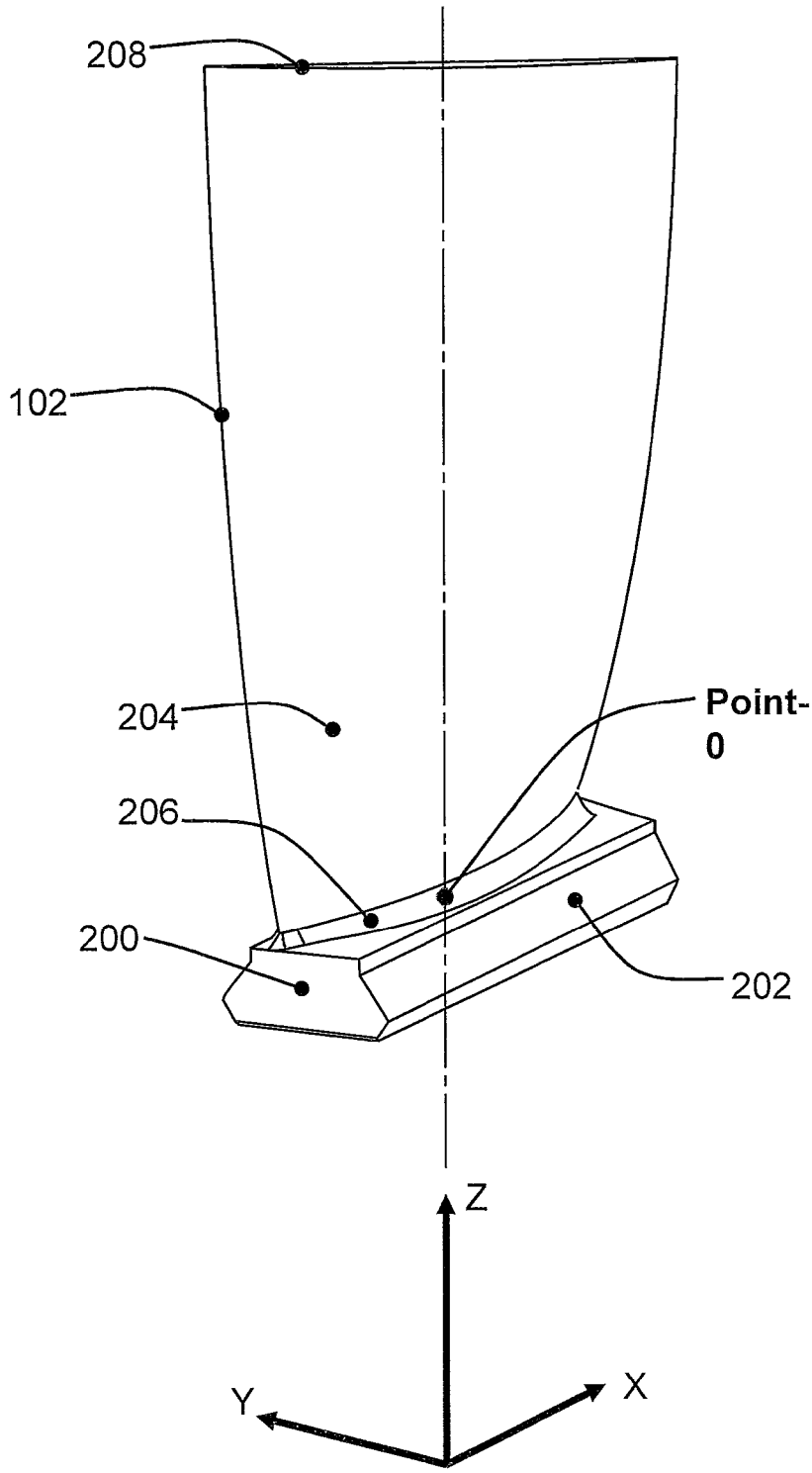
FIG. 4 illustrates aspects associated with a coordinate system used to define a loci of points according to an embodiment of the invention.

More specifically, the loci defines the rotor blade airfoil profile according to embodiments of the invention and can include a set of points which are defined relative to an axis of rotation of the engine. For example, a Cartesian coordinate system of X, Y and Z values can be defined and used to reference the points in the loci. The Cartesian coordinate system has orthogonally-related X, Y and Z axes. According to this embodiment of the invention, the X axis lies parallel to the engine's centerline, as illustrated in FIG. 4. A positive X coordinate value is thus axial toward the aft, for example toward the exhaust end of the axial compressor. A positive Y coordinate value is directed circumferentially following engine counterclockwise direction of rotation. A positive Z coordinate value is directed radially outward toward tip of the airfoil 204, i.e., in the direction towards the static casing 108 of the compressor. For reference purposes only, there is established a Point-0 passing through the intersection of the airfoil 204 and the platform 200 along the stacking axis, as illustrated in FIG. 4. In accordance with embodiments of the invention of the airfoil, the Point-0 is defined as the reference section where the Z coordinate of the Table 1 below is at 416.97 millimeters, which is a set predetermined distance from the engine or rotor centerline.

The Table 1 of points which define the rotor blade 102's surface according to embodiments of the invention is provided below.

TABLE 1

| X | Y | Z | X | Y | Z | X | Y | Z |
|---|---|---|---|---|---|---|---|---|
| SECTION 1 Z = 416.97 | | | | | | | | |
| −57.80 | 23.85 | 416.97 | 50.04 | −3.40 | 416.97 | −48.32 | 14.12 | 416.97 |
| −57.69 | 24.01 | 416.97 | 51.52 | −3.76 | 416.97 | −46.90 | 13.01 | 416.97 |
| −57.60 | 24.09 | 416.97 | 52.84 | −4.09 | 416.97 | −45.29 | 11.77 | 416.97 |
| −57.49 | 24.16 | 416.97 | 54.01 | −4.37 | 416.97 | −43.45 | 10.41 | 416.97 |
| −57.36 | 24.23 | 416.97 | 55.06 | −4.63 | 416.97 | −41.36 | 8.93 | 416.97 |
| −57.20 | 24.28 | 416.97 | 55.99 | −4.86 | 416.97 | −38.97 | 7.31 | 416.97 |
| −57.01 | 24.32 | 416.97 | 56.81 | −5.06 | 416.97 | −36.25 | 5.56 | 416.97 |
| −56.80 | 24.35 | 416.97 | 57.55 | −5.24 | 416.97 | −33.14 | 3.67 | 416.97 |
| −56.57 | 24.35 | 416.97 | 58.20 | −5.40 | 416.97 | −29.58 | 1.66 | 416.97 |
| −56.30 | 24.33 | 416.97 | 58.79 | −5.54 | 416.97 | −25.50 | −0.45 | 416.97 |
| −56.00 | 24.28 | 416.97 | 59.31 | −5.66 | 416.97 | −20.82 | −2.64 | 416.97 |
| −55.68 | 24.20 | 416.97 | 59.77 | −5.78 | 416.97 | −15.46 | −4.85 | 416.97 |
| −55.31 | 24.10 | 416.97 | 60.18 | −5.88 | 416.97 | −9.32 | −7.03 | 416.97 |
| −54.91 | 23.97 | 416.97 | 60.54 | −5.97 | 416.97 | −2.29 | −9.08 | 416.97 |
| −54.46 | 23.83 | 416.97 | 60.87 | −6.04 | 416.97 | 4.86 | −10.70 | 416.97 |
| −53.94 | 23.67 | 416.97 | 61.16 | −6.12 | 416.97 | 11.30 | −11.79 | 416.97 |
| −53.36 | 23.51 | 416.97 | 61.41 | −6.19 | 416.97 | 17.07 | −12.46 | 416.97 |
| −52.71 | 23.34 | 416.97 | 61.63 | −6.30 | 416.97 | 22.22 | −12.84 | 416.97 |
| −51.98 | 23.15 | 416.97 | 61.79 | −6.43 | 416.97 | 26.82 | −12.99 | 416.97 |
| −51.15 | 22.95 | 416.97 | 61.92 | −6.57 | 416.97 | 30.91 | −12.98 | 416.97 |
| −50.22 | 22.70 | 416.97 | 62.02 | −6.70 | 416.97 | 34.56 | −12.85 | 416.97 |
| −49.18 | 22.43 | 416.97 | 62.08 | −6.84 | 416.97 | 37.79 | −12.65 | 416.97 |
| −48.02 | 22.11 | 416.97 | 62.12 | −6.96 | 416.97 | 40.67 | −12.39 | 416.97 |
| −46.70 | 21.76 | 416.97 | 62.15 | −7.08 | 416.97 | 43.22 | −12.11 | 416.97 |

TABLE 1-continued

| X | Y | Z | X | Y | Z | X | Y | Z |
|---|---|---|---|---|---|---|---|---|
| −45.23 | 21.36 | 416.97 | 62.16 | −7.18 | 416.97 | 45.49 | −11.82 | 416.97 |
| −43.58 | 20.91 | 416.97 | 62.18 | −7.36 | 416.97 | 47.50 | −11.51 | 416.97 |
| −41.71 | 20.41 | 416.97 | −57.87 | 23.68 | 416.97 | 49.29 | −11.22 | 416.97 |
| −39.62 | 19.86 | 416.97 | −57.90 | 23.57 | 416.97 | 50.88 | −10.93 | 416.97 |
| −37.27 | 19.23 | 416.97 | −57.90 | 23.45 | 416.97 | 52.28 | −10.66 | 416.97 |
| −34.63 | 18.52 | 416.97 | −57.90 | 23.31 | 416.97 | 53.53 | −10.40 | 416.97 |
| −31.66 | 17.73 | 416.97 | −57.87 | 23.15 | 416.97 | 54.65 | −10.17 | 416.97 |
| −28.33 | 16.83 | 416.97 | −57.82 | 22.98 | 416.97 | 55.63 | −9.94 | 416.97 |
| −24.58 | 15.83 | 416.97 | −57.74 | 22.80 | 416.97 | 56.51 | −9.74 | 416.97 |
| −20.38 | 14.70 | 416.97 | −57.64 | 22.60 | 416.97 | 57.29 | −9.55 | 416.97 |
| −15.64 | 13.44 | 416.97 | −57.50 | 22.39 | 416.97 | 57.98 | −9.38 | 416.97 |
| −10.33 | 12.04 | 416.97 | −57.33 | 22.17 | 416.97 | 58.59 | −9.22 | 416.97 |
| −4.35 | 10.47 | 416.97 | −57.12 | 21.94 | 416.97 | 59.14 | −9.08 | 416.97 |
| 2.37 | 8.73 | 416.97 | −56.87 | 21.69 | 416.97 | 59.63 | −8.96 | 416.97 |
| 9.09 | 6.99 | 416.97 | −56.58 | 21.42 | 416.97 | 60.06 | −8.84 | 416.97 |
| 15.06 | 5.45 | 416.97 | −56.24 | 21.12 | 416.97 | 60.44 | −8.73 | 416.97 |
| 20.38 | 4.08 | 416.97 | −55.87 | 20.78 | 416.97 | 60.78 | −8.64 | 416.97 |
| 25.12 | 2.87 | 416.97 | −55.46 | 20.40 | 416.97 | 61.09 | −8.56 | 416.97 |
| 29.34 | 1.80 | 416.97 | −55.00 | 19.96 | 416.97 | 61.36 | −8.48 | 416.97 |
| 33.09 | 0.85 | 416.97 | −54.48 | 19.47 | 416.97 | 61.59 | −8.38 | 416.97 |
| 36.43 | 0.01 | 416.97 | −53.91 | 18.92 | 416.97 | 61.76 | −8.24 | 416.97 |
| 39.41 | −0.74 | 416.97 | −53.25 | 18.30 | 416.97 | 61.90 | −8.10 | 416.97 |
| 42.06 | −1.41 | 416.97 | −52.50 | 17.63 | 416.97 | 62.00 | −7.96 | 416.97 |
| 44.41 | −2.00 | 416.97 | −51.64 | 16.88 | 416.97 | 62.08 | −7.82 | 416.97 |
| 46.51 | −2.52 | 416.97 | −50.68 | 16.05 | 416.97 | 62.13 | −7.69 | 416.97 |
| 48.38 | −2.98 | 416.97 | −49.58 | 15.13 | 416.97 | 62.16 | −7.57 | 416.97 |
| | | | SECTION 2 Z = 424.59 | | | | | |
| −57.02 | 25.55 | 424.59 | 49.80 | −5.42 | 424.59 | −47.75 | 15.67 | 424.59 |
| −56.90 | 25.70 | 424.59 | 51.27 | −5.84 | 424.59 | −46.35 | 14.53 | 424.59 |
| −56.81 | 25.78 | 424.59 | 52.57 | −6.21 | 424.59 | −44.78 | 13.26 | 424.59 |
| −56.70 | 25.85 | 424.59 | 53.73 | −6.54 | 424.59 | −42.98 | 11.86 | 424.59 |
| −56.56 | 25.91 | 424.59 | 54.77 | −6.83 | 424.59 | −40.93 | 10.33 | 424.59 |
| −56.40 | 25.96 | 424.59 | 55.69 | −7.09 | 424.59 | −38.60 | 8.66 | 424.59 |
| −56.22 | 25.99 | 424.59 | 56.51 | −7.33 | 424.59 | −35.93 | 6.85 | 424.59 |
| −56.01 | 26.01 | 424.59 | 57.24 | −7.53 | 424.59 | −32.87 | 4.89 | 424.59 |
| −55.77 | 26.00 | 424.59 | 57.88 | −7.72 | 424.59 | −29.38 | 2.80 | 424.59 |
| −55.50 | 25.97 | 424.59 | 58.46 | −7.88 | 424.59 | −25.37 | 0.58 | 424.59 |
| −55.21 | 25.90 | 424.59 | 58.98 | −8.02 | 424.59 | −20.78 | −1.73 | 424.59 |
| −54.89 | 25.81 | 424.59 | 59.43 | −8.15 | 424.59 | −15.51 | −4.10 | 424.59 |
| −54.53 | 25.70 | 424.59 | 59.84 | −8.27 | 424.59 | −9.46 | −6.47 | 424.59 |
| −54.13 | 25.56 | 424.59 | 60.20 | −8.37 | 424.59 | −2.53 | −8.75 | 424.59 |
| −53.68 | 25.40 | 424.59 | 60.53 | −8.46 | 424.59 | 4.53 | −10.62 | 424.59 |
| −53.17 | 25.23 | 424.59 | 60.81 | −8.54 | 424.59 | 10.90 | −11.94 | 424.59 |
| −52.60 | 25.05 | 424.59 | 61.07 | −8.62 | 424.59 | 16.61 | −12.84 | 424.59 |
| −51.95 | 24.86 | 424.59 | 61.27 | −8.73 | 424.59 | 21.73 | −13.41 | 424.59 |
| −51.22 | 24.65 | 424.59 | 61.44 | −8.86 | 424.59 | 26.30 | −13.75 | 424.59 |
| −50.40 | 24.41 | 424.59 | 61.56 | −9.01 | 424.59 | 30.38 | −13.91 | 424.59 |
| −49.48 | 24.14 | 424.59 | 61.65 | −9.15 | 424.59 | 34.01 | −13.95 | 424.59 |
| −48.45 | 23.83 | 424.59 | 61.72 | −9.28 | 424.59 | 37.25 | −13.89 | 424.59 |
| −47.30 | 23.48 | 424.59 | 61.76 | −9.41 | 424.59 | 40.12 | −13.76 | 424.59 |
| −46.00 | 23.08 | 424.59 | 61.78 | −9.52 | 424.59 | 42.68 | −13.60 | 424.59 |
| −44.54 | 22.63 | 424.59 | 61.79 | −9.63 | 424.59 | 44.95 | −13.41 | 424.59 |
| −42.90 | 22.13 | 424.59 | 61.79 | −9.80 | 424.59 | 46.97 | −13.20 | 424.59 |
| −41.06 | 21.57 | 424.59 | −57.09 | 25.38 | 424.59 | 48.76 | −12.99 | 424.59 |
| −38.98 | 20.94 | 424.59 | −57.11 | 25.27 | 424.59 | 50.35 | −12.79 | 424.59 |
| −36.66 | 20.24 | 424.59 | −57.12 | 25.15 | 424.59 | 51.77 | −12.58 | 424.59 |
| −34.04 | 19.45 | 424.59 | −57.12 | 25.01 | 424.59 | 53.02 | −12.39 | 424.59 |
| −31.10 | 18.55 | 424.59 | −57.09 | 24.85 | 424.59 | 54.14 | −12.20 | 424.59 |
| −27.80 | 17.55 | 424.59 | −57.04 | 24.68 | 424.59 | 55.13 | −12.03 | 424.59 |
| −24.09 | 16.42 | 424.59 | −56.97 | 24.50 | 424.59 | 56.02 | −11.87 | 424.59 |
| −19.92 | 15.15 | 424.59 | −56.86 | 24.30 | 424.59 | 56.80 | −11.72 | 424.59 |
| −15.24 | 13.73 | 424.59 | −56.73 | 24.09 | 424.59 | 57.50 | −11.58 | 424.59 |
| −9.97 | 12.15 | 424.59 | −56.56 | 23.87 | 424.59 | 58.12 | −11.46 | 424.59 |
| −4.05 | 10.38 | 424.59 | −56.35 | 23.63 | 424.59 | 58.67 | −11.35 | 424.59 |
| 2.60 | 8.40 | 424.59 | −56.10 | 23.38 | 424.59 | 59.16 | −11.24 | 424.59 |
| 9.25 | 6.43 | 424.59 | −55.82 | 23.11 | 424.59 | 59.59 | −11.15 | 424.59 |
| 15.17 | 4.68 | 424.59 | −55.49 | 22.81 | 424.59 | 59.98 | −11.07 | 424.59 |
| 20.44 | 3.13 | 424.59 | −55.13 | 22.46 | 424.59 | 60.33 | −10.99 | 424.59 |
| 25.13 | 1.75 | 424.59 | −54.72 | 22.07 | 424.59 | 60.63 | −10.92 | 424.59 |
| 29.30 | 0.53 | 424.59 | −54.27 | 21.63 | 424.59 | 60.91 | −10.86 | 424.59 |
| 33.02 | −0.56 | 424.59 | −53.77 | 21.13 | 424.59 | 61.14 | −10.77 | 424.59 |
| 36.33 | −1.52 | 424.59 | −53.21 | 20.57 | 424.59 | 61.33 | −10.66 | 424.59 |
| 39.27 | −2.38 | 424.59 | −52.56 | 19.94 | 424.59 | 61.48 | −10.52 | 424.59 |
| 41.90 | −3.14 | 424.59 | −51.83 | 19.26 | 424.59 | 61.59 | −10.39 | 424.59 |
| 44.23 | −3.81 | 424.59 | −50.99 | 18.49 | 424.59 | 61.67 | −10.25 | 424.59 |
| 46.31 | −4.41 | 424.59 | −50.05 | 17.64 | 424.59 | 61.73 | −10.13 | 424.59 |
| 48.16 | −4.94 | 424.59 | −48.97 | 16.71 | 424.59 | 61.76 | −10.01 | 424.59 |

TABLE 1-continued

| X | Y | Z | X | Y | Z | X | Y | Z |
|---|---|---|---|---|---|---|---|---|
| | | | SECTION 3 Z = 432.21 | | | | | |
| −56.22 | 27.19 | 432.21 | 49.51 | −7.39 | 432.21 | −47.14 | 17.17 | 432.21 |
| −56.09 | 27.34 | 432.21 | 50.96 | −7.87 | 432.21 | −45.78 | 16.00 | 432.21 |
| −56.00 | 27.42 | 432.21 | 52.25 | −8.29 | 432.21 | −44.24 | 14.70 | 432.21 |
| −55.89 | 27.49 | 432.21 | 53.40 | −8.66 | 432.21 | −42.48 | 13.27 | 432.21 |
| −55.75 | 27.54 | 432.21 | 54.42 | −8.99 | 432.21 | −40.47 | 11.70 | 432.21 |
| −55.59 | 27.58 | 432.21 | 55.33 | −9.29 | 432.21 | −38.18 | 9.98 | 432.21 |
| −55.40 | 27.61 | 432.21 | 56.14 | −9.55 | 432.21 | −35.57 | 8.10 | 432.21 |
| −55.19 | 27.61 | 432.21 | 56.86 | −9.78 | 432.21 | −32.57 | 6.08 | 432.21 |
| −54.96 | 27.60 | 432.21 | 57.51 | −9.99 | 432.21 | −29.14 | 3.90 | 432.21 |
| −54.69 | 27.55 | 432.21 | 58.08 | −10.17 | 432.21 | −25.21 | 1.58 | 432.21 |
| −54.40 | 27.48 | 432.21 | 58.59 | −10.33 | 432.21 | −20.70 | −0.86 | 432.21 |
| −54.08 | 27.38 | 432.21 | 59.04 | −10.48 | 432.21 | −15.52 | −3.38 | 432.21 |
| −53.73 | 27.25 | 432.21 | 59.44 | −10.61 | 432.21 | −9.57 | −5.93 | 432.21 |
| −53.33 | 27.09 | 432.21 | 59.80 | −10.73 | 432.21 | −2.73 | −8.42 | 432.21 |
| −52.89 | 26.92 | 432.21 | 60.12 | −10.83 | 432.21 | 4.24 | −10.53 | 432.21 |
| −52.38 | 26.74 | 432.21 | 60.40 | −10.92 | 432.21 | 10.53 | −12.08 | 432.21 |
| −51.82 | 26.54 | 432.21 | 60.65 | −11.01 | 432.21 | 16.20 | −13.19 | 432.21 |
| −51.18 | 26.33 | 432.21 | 60.86 | −11.12 | 432.21 | 21.27 | −13.97 | 432.21 |
| −50.45 | 26.10 | 432.21 | 61.02 | −11.25 | 432.21 | 25.81 | −14.49 | 432.21 |
| −49.64 | 25.83 | 432.21 | 61.15 | −11.39 | 432.21 | 29.87 | −14.82 | 432.21 |
| −48.74 | 25.53 | 432.21 | 61.23 | −11.54 | 432.21 | 33.48 | −15.01 | 432.21 |
| −47.72 | 25.18 | 432.21 | 61.30 | −11.67 | 432.21 | 36.70 | −15.09 | 432.21 |
| −46.57 | 24.79 | 432.21 | 61.33 | −11.80 | 432.21 | 39.57 | −15.09 | 432.21 |
| −45.29 | 24.35 | 432.21 | 61.35 | −11.91 | 432.21 | 42.12 | −15.05 | 432.21 |
| −43.84 | 23.86 | 432.21 | 61.36 | −12.02 | 432.21 | 44.39 | −14.96 | 432.21 |
| −42.22 | 23.30 | 432.21 | 61.35 | −12.19 | 432.21 | 46.41 | −14.85 | 432.21 |
| −40.39 | 22.68 | 432.21 | −56.29 | 27.02 | 432.21 | 48.21 | −14.72 | 432.21 |
| −38.34 | 21.99 | 432.21 | −56.31 | 26.91 | 432.21 | 49.80 | −14.59 | 432.21 |
| −36.04 | 21.21 | 432.21 | −56.32 | 26.79 | 432.21 | 51.22 | −14.45 | 432.21 |
| −33.45 | 20.33 | 432.21 | −56.32 | 26.65 | 432.21 | 52.48 | −14.32 | 432.21 |
| −30.54 | 19.34 | 432.21 | −56.29 | 26.50 | 432.21 | 53.60 | −14.19 | 432.21 |
| −27.27 | 18.23 | 432.21 | −56.25 | 26.33 | 432.21 | 54.60 | −14.07 | 432.21 |
| −23.60 | 16.98 | 432.21 | −56.17 | 26.15 | 432.21 | 55.49 | −13.95 | 432.21 |
| −19.48 | 15.58 | 432.21 | −56.07 | 25.95 | 432.21 | 56.27 | −13.84 | 432.21 |
| −14.84 | 14.00 | 432.21 | −55.94 | 25.74 | 432.21 | 56.98 | −13.74 | 432.21 |
| −9.63 | 12.24 | 432.21 | −55.77 | 25.52 | 432.21 | 57.60 | −13.64 | 432.21 |
| −3.77 | 10.27 | 432.21 | −55.56 | 25.28 | 432.21 | 58.15 | −13.56 | 432.21 |
| 2.81 | 8.07 | 432.21 | −55.32 | 25.03 | 432.21 | 58.65 | −13.48 | 432.21 |
| 9.39 | 5.87 | 432.21 | −55.04 | 24.75 | 432.21 | 59.08 | −13.41 | 432.21 |
| 15.25 | 3.92 | 432.21 | −54.72 | 24.44 | 432.21 | 59.47 | −13.34 | 432.21 |
| 20.46 | 2.19 | 432.21 | −54.37 | 24.09 | 432.21 | 59.82 | −13.28 | 432.21 |
| 25.10 | 0.65 | 432.21 | −53.97 | 23.69 | 432.21 | 60.13 | −13.23 | 432.21 |
| 29.23 | −0.72 | 432.21 | −53.53 | 23.24 | 432.21 | 60.41 | −13.18 | 432.21 |
| 32.91 | −1.94 | 432.21 | −53.04 | 22.73 | 432.21 | 60.64 | −13.12 | 432.21 |
| 36.18 | −3.02 | 432.21 | −52.49 | 22.16 | 432.21 | 60.84 | −13.02 | 432.21 |
| 39.10 | −3.98 | 432.21 | −51.86 | 21.53 | 432.21 | 61.00 | −12.90 | 432.21 |
| 41.69 | −4.83 | 432.21 | −51.14 | 20.83 | 432.21 | 61.12 | −12.77 | 432.21 |
| 44.00 | −5.59 | 432.21 | −50.32 | 20.05 | 432.21 | 61.21 | −12.64 | 432.21 |
| 46.05 | −6.27 | 432.21 | −49.40 | 19.19 | 432.21 | 61.27 | −12.51 | 432.21 |
| 47.88 | −6.86 | 432.21 | −48.34 | 18.23 | 432.21 | 61.31 | −12.40 | 432.21 |
| | | | SECTION 4 Z = 449.99 | | | | | |
| −54.26 | 30.72 | 449.99 | 48.53 | −11.75 | 449.99 | −45.63 | 20.42 | 449.99 |
| −54.13 | 30.86 | 449.99 | 49.94 | −12.34 | 449.99 | −44.33 | 19.19 | 449.99 |
| −54.04 | 30.93 | 449.99 | 51.19 | −12.86 | 449.99 | −42.86 | 17.83 | 449.99 |
| −53.92 | 30.99 | 449.99 | 52.30 | −13.33 | 449.99 | −41.19 | 16.33 | 449.99 |
| −53.77 | 31.03 | 449.99 | 53.30 | −13.74 | 449.99 | −39.28 | 14.67 | 449.99 |
| −53.61 | 31.06 | 449.99 | 54.18 | −14.10 | 449.99 | −37.10 | 12.85 | 449.99 |
| −53.42 | 31.07 | 449.99 | 54.96 | −14.43 | 449.99 | −34.60 | 10.85 | 449.99 |
| −53.21 | 31.05 | 449.99 | 55.66 | −14.72 | 449.99 | −31.75 | 8.68 | 449.99 |
| −52.98 | 31.01 | 449.99 | 56.29 | −14.98 | 449.99 | −28.47 | 6.32 | 449.99 |
| −52.72 | 30.94 | 449.99 | 56.84 | −15.21 | 449.99 | −24.72 | 3.79 | 449.99 |
| −52.44 | 30.84 | 449.99 | 57.34 | −15.41 | 449.99 | −20.39 | 1.09 | 449.99 |
| −52.13 | 30.71 | 449.99 | 57.77 | −15.60 | 449.99 | −15.42 | −1.75 | 449.99 |
| −51.79 | 30.55 | 449.99 | 58.17 | −15.76 | 449.99 | −9.70 | −4.68 | 449.99 |
| −51.40 | 30.37 | 449.99 | 58.51 | −15.90 | 449.99 | −3.12 | −7.65 | 449.99 |
| −50.97 | 30.18 | 449.99 | 58.82 | −16.03 | 449.99 | 3.62 | −10.28 | 449.99 |
| −50.48 | 29.96 | 449.99 | 59.10 | −16.14 | 449.99 | 9.72 | −12.32 | 449.99 |
| −49.93 | 29.73 | 449.99 | 59.34 | −16.24 | 449.99 | 15.23 | −13.90 | 449.99 |
| −49.31 | 29.47 | 449.99 | 59.55 | −16.35 | 449.99 | 20.19 | −15.12 | 449.99 |
| −48.60 | 29.18 | 449.99 | 59.71 | −16.49 | 449.99 | 24.63 | −16.04 | 449.99 |
| −47.81 | 28.86 | 449.99 | 59.83 | −16.63 | 449.99 | 28.61 | −16.75 | 449.99 |
| −46.93 | 28.49 | 449.99 | 59.92 | −16.78 | 449.99 | 32.16 | −17.27 | 449.99 |
| −45.94 | 28.07 | 449.99 | 59.97 | −16.92 | 449.99 | 35.34 | −17.67 | 449.99 |
| −44.82 | 27.60 | 449.99 | 60.00 | −17.05 | 449.99 | 38.17 | −17.95 | 449.99 |
| −43.57 | 27.07 | 449.99 | 60.02 | −17.16 | 449.99 | 40.69 | −18.16 | 449.99 |

TABLE 1-continued

| X | Y | Z | X | Y | Z | X | Y | Z |
|---|---|---|---|---|---|---|---|---|
| −42.17 | 26.47 | 449.99 | 60.02 | −17.27 | 449.99 | 42.94 | −18.31 | 449.99 |
| −40.59 | 25.80 | 449.99 | 59.99 | −17.44 | 449.99 | 44.95 | −18.41 | 449.99 |
| −38.82 | 25.05 | 449.99 | −54.34 | 30.55 | 449.99 | 46.73 | −18.47 | 449.99 |
| −36.82 | 24.22 | 449.99 | −54.37 | 30.45 | 449.99 | 48.32 | −18.50 | 449.99 |
| −34.58 | 23.27 | 449.99 | −54.38 | 30.32 | 449.99 | 49.74 | −18.52 | 449.99 |
| −32.06 | 22.21 | 449.99 | −54.37 | 30.18 | 449.99 | 50.99 | −18.52 | 449.99 |
| −29.23 | 21.01 | 449.99 | −54.35 | 30.03 | 449.99 | 52.12 | −18.52 | 449.99 |
| −26.06 | 19.66 | 449.99 | −54.30 | 29.86 | 449.99 | 53.11 | −18.50 | 449.99 |
| −22.49 | 18.15 | 449.99 | −54.23 | 29.68 | 449.99 | 54.00 | −18.48 | 449.99 |
| −18.48 | 16.45 | 449.99 | −54.13 | 29.49 | 449.99 | 54.79 | −18.46 | 449.99 |
| −13.97 | 14.54 | 449.99 | −54.00 | 29.28 | 449.99 | 55.49 | −18.44 | 449.99 |
| −8.90 | 12.39 | 449.99 | −53.84 | 29.05 | 449.99 | 56.12 | −18.41 | 449.99 |
| −3.21 | 9.99 | 449.99 | −53.64 | 28.81 | 449.99 | 56.67 | −18.39 | 449.99 |
| 3.19 | 7.29 | 449.99 | −53.40 | 28.56 | 449.99 | 57.17 | −18.37 | 449.99 |
| 9.58 | 4.61 | 449.99 | −53.14 | 28.27 | 449.99 | 57.61 | −18.34 | 449.99 |
| 15.27 | 2.21 | 449.99 | −52.83 | 27.95 | 449.99 | 58.00 | −18.32 | 449.99 |
| 20.33 | 0.08 | 449.99 | −52.50 | 27.59 | 449.99 | 58.35 | −18.30 | 449.99 |
| 24.84 | −1.81 | 449.99 | −52.12 | 27.18 | 449.99 | 58.66 | −18.29 | 449.99 |
| 28.85 | −3.50 | 449.99 | −51.70 | 26.71 | 449.99 | 58.94 | −18.27 | 449.99 |
| 32.42 | −5.00 | 449.99 | −51.24 | 26.19 | 449.99 | 59.18 | −18.25 | 449.99 |
| 35.59 | −6.33 | 449.99 | −50.71 | 25.60 | 449.99 | 59.39 | −18.18 | 449.99 |
| 38.42 | −7.52 | 449.99 | −50.11 | 24.95 | 449.99 | 59.56 | −18.09 | 449.99 |
| 40.94 | −8.58 | 449.99 | −49.43 | 24.23 | 449.99 | 59.70 | −17.98 | 449.99 |
| 43.18 | −9.52 | 449.99 | −48.65 | 23.42 | 449.99 | 59.80 | −17.86 | 449.99 |
| 45.17 | −10.35 | 449.99 | −47.77 | 22.52 | 449.99 | 59.88 | −17.75 | 449.99 |
| 46.95 | −11.09 | 449.99 | −46.77 | 21.52 | 449.99 | 59.94 | −17.64 | 449.99 |
| | | | SECTION 5 Z = 467.77 | | | | | |
| −52.24 | 33.86 | 467.77 | 47.26 | −15.76 | 467.77 | −44.00 | 23.34 | 467.77 |
| −52.11 | 34.00 | 467.77 | 48.62 | −16.45 | 467.77 | −42.77 | 22.07 | 467.77 |
| −52.01 | 34.06 | 467.77 | 49.82 | −17.07 | 467.77 | −41.37 | 20.65 | 467.77 |
| −51.89 | 34.11 | 467.77 | 50.90 | −17.61 | 467.77 | −39.77 | 19.08 | 467.77 |
| −51.74 | 34.14 | 467.77 | 51.86 | −18.10 | 467.77 | −37.95 | 17.35 | 467.77 |
| −51.57 | 34.16 | 467.77 | 52.71 | −18.53 | 467.77 | −35.87 | 15.44 | 467.77 |
| −51.39 | 34.15 | 467.77 | 53.47 | −18.92 | 467.77 | −33.50 | 13.34 | 467.77 |
| −51.18 | 34.11 | 467.77 | 54.15 | −19.26 | 467.77 | −30.77 | 11.04 | 467.77 |
| −50.95 | 34.05 | 467.77 | 54.75 | −19.56 | 467.77 | −27.65 | 8.54 | 467.77 |
| −50.70 | 33.96 | 467.77 | 55.28 | −19.84 | 467.77 | −24.06 | 5.82 | 467.77 |
| −50.43 | 33.83 | 467.77 | 55.76 | −20.08 | 467.77 | −19.93 | 2.90 | 467.77 |
| −50.13 | 33.68 | 467.77 | 56.18 | −20.29 | 467.77 | −15.18 | −0.21 | 467.77 |
| −49.80 | 33.49 | 467.77 | 56.56 | −20.48 | 467.77 | −9.70 | −3.49 | 467.77 |
| −49.43 | 33.29 | 467.77 | 56.90 | −20.65 | 467.77 | −3.38 | −6.89 | 467.77 |
| −49.01 | 33.07 | 467.77 | 57.19 | −20.80 | 467.77 | 3.11 | −9.98 | 467.77 |
| −48.53 | 32.82 | 467.77 | 57.46 | −20.94 | 467.77 | 9.00 | −12.47 | 467.77 |
| −48.00 | 32.55 | 467.77 | 57.70 | −21.06 | 467.77 | 14.32 | −14.47 | 467.77 |
| −47.39 | 32.25 | 467.77 | 57.91 | −21.17 | 467.77 | 19.13 | −16.08 | 467.77 |
| −46.71 | 31.92 | 467.77 | 58.07 | −21.30 | 467.77 | 23.44 | −17.38 | 467.77 |
| −45.95 | 31.54 | 467.77 | 58.18 | −21.45 | 467.77 | 27.32 | −18.43 | 467.77 |
| −45.09 | 31.11 | 467.77 | 58.26 | −21.59 | 467.77 | 30.78 | −19.27 | 467.77 |
| −44.13 | 30.63 | 467.77 | 58.31 | −21.73 | 467.77 | 33.89 | −19.95 | 467.77 |
| −43.05 | 30.09 | 467.77 | 58.34 | −21.86 | 467.77 | 36.66 | −20.51 | 467.77 |
| −41.84 | 29.47 | 467.77 | 58.34 | −21.98 | 467.77 | 39.14 | −20.95 | 467.77 |
| −40.48 | 28.78 | 467.77 | 58.33 | −22.09 | 467.77 | 41.35 | −21.31 | 467.77 |
| −38.95 | 28.01 | 467.77 | 58.30 | −22.26 | 467.77 | 43.32 | −21.61 | 467.77 |
| −37.23 | 27.14 | 467.77 | −52.33 | 33.70 | 467.77 | 45.08 | −21.85 | 467.77 |
| −35.30 | 26.17 | 467.77 | −52.36 | 33.60 | 467.77 | 46.64 | −22.04 | 467.77 |
| −33.12 | 25.07 | 467.77 | −52.37 | 33.47 | 467.77 | 48.04 | −22.20 | 467.77 |
| −30.69 | 23.84 | 467.77 | −52.36 | 33.34 | 467.77 | 49.28 | −22.33 | 467.77 |
| −27.95 | 22.45 | 467.77 | −52.34 | 33.19 | 467.77 | 50.39 | −22.44 | 467.77 |
| −24.87 | 20.89 | 467.77 | −52.29 | 33.02 | 467.77 | 51.38 | −22.53 | 467.77 |
| −21.41 | 19.14 | 467.77 | −52.22 | 32.84 | 467.77 | 52.25 | −22.60 | 467.77 |
| −17.53 | 17.17 | 467.77 | −52.13 | 32.64 | 467.77 | 53.04 | −22.66 | 467.77 |
| −13.17 | 14.95 | 467.77 | −52.00 | 32.44 | 467.77 | 53.73 | −22.71 | 467.77 |
| −8.27 | 12.46 | 467.77 | −51.84 | 32.21 | 467.77 | 54.35 | −22.76 | 467.77 |
| −2.76 | 9.67 | 467.77 | −51.64 | 31.97 | 467.77 | 54.91 | −22.79 | 467.77 |
| 3.43 | 6.53 | 467.77 | −51.41 | 31.71 | 467.77 | 55.40 | −22.82 | 467.77 |
| 9.62 | 3.39 | 467.77 | −51.16 | 31.42 | 467.77 | 55.83 | −22.85 | 467.77 |
| 15.12 | 0.60 | 467.77 | −50.87 | 31.09 | 467.77 | 56.22 | −22.87 | 467.77 |
| 20.01 | −1.89 | 467.77 | −50.55 | 30.71 | 467.77 | 56.57 | −22.88 | 467.77 |
| 24.37 | −4.11 | 467.77 | −50.19 | 30.29 | 467.77 | 56.88 | −22.90 | 467.77 |
| 28.24 | −6.08 | 467.77 | −49.80 | 29.81 | 467.77 | 57.15 | −22.91 | 467.77 |
| 31.69 | −7.84 | 467.77 | −49.35 | 29.28 | 467.77 | 57.40 | −22.92 | 467.77 |
| 34.76 | −9.40 | 467.77 | −48.85 | 28.68 | 467.77 | 57.61 | −22.90 | 467.77 |
| 37.49 | −10.79 | 467.77 | −48.27 | 28.01 | 467.77 | 57.80 | −22.84 | 467.77 |
| 39.93 | −12.03 | 467.77 | −47.62 | 27.27 | 467.77 | 57.95 | −22.75 | 467.77 |
| 42.09 | −13.13 | 467.77 | −46.88 | 26.44 | 467.77 | 58.06 | −22.65 | 467.77 |
| 44.02 | −14.11 | 467.77 | −46.04 | 25.51 | 467.77 | 58.15 | −22.55 | 467.77 |
| 45.73 | −14.99 | 467.77 | −45.09 | 24.48 | 467.77 | 58.22 | −22.45 | 467.77 |

TABLE 1-continued

| X | Y | Z | X | Y | Z | X | Y | Z |
|---|---|---|---|---|---|---|---|---|
| | | | SECTION 6 Z = 493.17 | | | | | |
| −49.36 | 37.78 | 493.17 | 45.08 | −20.88 | 493.17 | −41.59 | 27.00 | 493.17 |
| −49.21 | 37.91 | 493.17 | 46.36 | −21.70 | 493.17 | −40.44 | 25.67 | 493.17 |
| −49.10 | 37.96 | 493.17 | 47.50 | −22.43 | 493.17 | −39.13 | 24.20 | 493.17 |
| −48.97 | 37.99 | 493.17 | 48.52 | −23.07 | 493.17 | −37.64 | 22.56 | 493.17 |
| −48.83 | 38.01 | 493.17 | 49.42 | −23.65 | 493.17 | −35.94 | 20.74 | 493.17 |
| −48.66 | 37.99 | 493.17 | 50.23 | −24.17 | 493.17 | −33.99 | 18.73 | 493.17 |
| −48.48 | 37.96 | 493.17 | 50.95 | −24.62 | 493.17 | −31.77 | 16.50 | 493.17 |
| −48.27 | 37.89 | 493.17 | 51.58 | −25.03 | 493.17 | −29.22 | 14.05 | 493.17 |
| −48.06 | 37.80 | 493.17 | 52.15 | −25.39 | 493.17 | −26.30 | 11.36 | 493.17 |
| −47.82 | 37.68 | 493.17 | 52.66 | −25.72 | 493.17 | −22.94 | 8.42 | 493.17 |
| −47.57 | 37.52 | 493.17 | 53.11 | −26.00 | 493.17 | −19.07 | 5.22 | 493.17 |
| −47.29 | 37.34 | 493.17 | 53.51 | −26.26 | 493.17 | −14.62 | 1.77 | 493.17 |
| −46.97 | 37.13 | 493.17 | 53.87 | −26.49 | 493.17 | −9.48 | −1.92 | 493.17 |
| −46.62 | 36.90 | 493.17 | 54.18 | −26.69 | 493.17 | −3.54 | −5.84 | 493.17 |
| −46.22 | 36.64 | 493.17 | 54.46 | −26.87 | 493.17 | 2.56 | −9.51 | 493.17 |
| −45.76 | 36.36 | 493.17 | 54.72 | −27.03 | 493.17 | 8.12 | −12.56 | 493.17 |
| −45.25 | 36.04 | 493.17 | 54.94 | −27.17 | 493.17 | 13.16 | −15.10 | 493.17 |
| −44.68 | 35.69 | 493.17 | 55.14 | −27.30 | 493.17 | 17.72 | −17.21 | 493.17 |
| −44.03 | 35.30 | 493.17 | 55.31 | −27.42 | 493.17 | 21.82 | −18.98 | 493.17 |
| −43.30 | 34.85 | 493.17 | 55.43 | −27.57 | 493.17 | 25.51 | −20.47 | 493.17 |
| −42.49 | 34.35 | 493.17 | 55.50 | −27.71 | 493.17 | 28.83 | −21.71 | 493.17 |
| −41.58 | 33.78 | 493.17 | 55.55 | −27.86 | 493.17 | 31.79 | −22.76 | 493.17 |
| −40.55 | 33.14 | 493.17 | 55.57 | −27.99 | 493.17 | 34.45 | −23.65 | 493.17 |
| −39.40 | 32.42 | 493.17 | 55.56 | −28.10 | 493.17 | 36.83 | −24.41 | 493.17 |
| −38.10 | 31.62 | 493.17 | 55.55 | −28.21 | 493.17 | 38.96 | −25.05 | 493.17 |
| −36.65 | 30.71 | 493.17 | 55.49 | −28.37 | 493.17 | 40.86 | −25.60 | 493.17 |
| −35.01 | 29.70 | 493.17 | −49.44 | 37.62 | 493.17 | 42.55 | −26.07 | 493.17 |
| −33.18 | 28.55 | 493.17 | −49.47 | 37.52 | 493.17 | 44.06 | −26.47 | 493.17 |
| −31.11 | 27.27 | 493.17 | −49.48 | 37.40 | 493.17 | 45.41 | −26.81 | 493.17 |
| −28.80 | 25.82 | 493.17 | −49.47 | 37.26 | 493.17 | 46.62 | −27.11 | 493.17 |
| −26.19 | 24.19 | 493.17 | −49.45 | 37.11 | 493.17 | 47.69 | −27.37 | 493.17 |
| −23.27 | 22.37 | 493.17 | −49.40 | 36.95 | 493.17 | 48.65 | −27.59 | 493.17 |
| −19.99 | 20.31 | 493.17 | −49.33 | 36.77 | 493.17 | 49.50 | −27.79 | 493.17 |
| −16.30 | 17.99 | 493.17 | −49.23 | 36.58 | 493.17 | 50.26 | −27.95 | 493.17 |
| −12.16 | 15.39 | 493.17 | −49.10 | 36.37 | 493.17 | 50.94 | −28.10 | 493.17 |
| −7.51 | 12.47 | 493.17 | −48.94 | 36.15 | 493.17 | 51.54 | −28.23 | 493.17 |
| −2.28 | 9.18 | 493.17 | −48.76 | 35.91 | 493.17 | 52.08 | −28.34 | 493.17 |
| 3.59 | 5.48 | 493.17 | −48.54 | 35.64 | 493.17 | 52.55 | −28.44 | 493.17 |
| 9.45 | 1.78 | 493.17 | −48.30 | 35.33 | 493.17 | 52.98 | −28.53 | 493.17 |
| 14.66 | −1.52 | 493.17 | −48.04 | 34.99 | 493.17 | 53.36 | −28.60 | 493.17 |
| 19.30 | −4.46 | 493.17 | −47.74 | 34.61 | 493.17 | 53.70 | −28.67 | 493.17 |
| 23.42 | −7.07 | 493.17 | −47.40 | 34.17 | 493.17 | 54.00 | −28.73 | 493.17 |
| 27.09 | −9.41 | 493.17 | −47.03 | 33.68 | 493.17 | 54.26 | −28.78 | 493.17 |
| 30.36 | −11.48 | 493.17 | −46.61 | 33.13 | 493.17 | 54.50 | −28.83 | 493.17 |
| 33.26 | −13.34 | 493.17 | −46.14 | 32.52 | 493.17 | 54.72 | −28.86 | 493.17 |
| 35.85 | −14.98 | 493.17 | −45.60 | 31.83 | 493.17 | 54.91 | −28.85 | 493.17 |
| 38.14 | −16.45 | 493.17 | −44.98 | 31.07 | 493.17 | 55.07 | −28.80 | 493.17 |
| 40.19 | −17.76 | 493.17 | −44.29 | 30.21 | 493.17 | 55.20 | −28.72 | 493.17 |
| 42.01 | −18.92 | 493.17 | −43.50 | 29.26 | 493.17 | 55.31 | −28.64 | 493.17 |
| 43.63 | −19.95 | 493.17 | −42.61 | 28.19 | 493.17 | 55.39 | −28.55 | 493.17 |
| | | | SECTION 7 Z = 518.57 | | | | | |
| −46.54 | 41.08 | 518.57 | 42.64 | −25.24 | 518.57 | −39.19 | 30.09 | 518.57 |
| −46.38 | 41.20 | 518.57 | 43.85 | −26.17 | 518.57 | −38.11 | 28.72 | 518.57 |
| −46.27 | 41.23 | 518.57 | 44.92 | −26.99 | 518.57 | −36.88 | 27.20 | 518.57 |
| −46.14 | 41.24 | 518.57 | 45.88 | −27.73 | 518.57 | −35.48 | 25.50 | 518.57 |
| −45.99 | 41.23 | 518.57 | 46.73 | −28.38 | 518.57 | −33.88 | 23.61 | 518.57 |
| −45.83 | 41.20 | 518.57 | 47.49 | −28.97 | 518.57 | −32.06 | 21.51 | 518.57 |
| −45.65 | 41.13 | 518.57 | 48.16 | −29.49 | 518.57 | −29.97 | 19.19 | 518.57 |
| −45.46 | 41.04 | 518.57 | 48.76 | −29.95 | 518.57 | −27.59 | 16.62 | 518.57 |
| −45.26 | 40.92 | 518.57 | 49.29 | −30.36 | 518.57 | −24.85 | 13.78 | 518.57 |
| −45.04 | 40.77 | 518.57 | 49.77 | −30.72 | 518.57 | −21.70 | 10.65 | 518.57 |
| −44.80 | 40.59 | 518.57 | 50.19 | −31.05 | 518.57 | −18.09 | 7.23 | 518.57 |
| −44.54 | 40.38 | 518.57 | 50.57 | −31.34 | 518.57 | −13.92 | 3.50 | 518.57 |
| −44.24 | 40.15 | 518.57 | 50.90 | −31.60 | 518.57 | −9.11 | −0.54 | 518.57 |
| −43.90 | 39.90 | 518.57 | 51.20 | −31.83 | 518.57 | −3.55 | −4.90 | 518.57 |
| −43.52 | 39.62 | 518.57 | 51.46 | −32.03 | 518.57 | 2.18 | −9.05 | 518.57 |
| −43.09 | 39.30 | 518.57 | 51.70 | −32.21 | 518.57 | 7.41 | −12.57 | 518.57 |
| −42.60 | 38.94 | 518.57 | 51.91 | −32.37 | 518.57 | 12.15 | −15.56 | 518.57 |
| −42.06 | 38.55 | 518.57 | 52.10 | −32.52 | 518.57 | 16.44 | −18.11 | 518.57 |
| −41.44 | 38.10 | 518.57 | 52.26 | −32.65 | 518.57 | 20.32 | −20.28 | 518.57 |
| −40.76 | 37.60 | 518.57 | 52.39 | −32.78 | 518.57 | 23.80 | −22.13 | 518.57 |
| −39.99 | 37.03 | 518.57 | 52.47 | −32.93 | 518.57 | 26.94 | −23.72 | 518.57 |
| −39.12 | 36.40 | 518.57 | 52.52 | −33.07 | 518.57 | 29.75 | −25.09 | 518.57 |
| −38.15 | 35.68 | 518.57 | 52.53 | −33.20 | 518.57 | 32.27 | −26.27 | 518.57 |
| −37.06 | 34.87 | 518.57 | 52.53 | −33.32 | 518.57 | 34.53 | −27.29 | 518.57 |

TABLE 1-continued

| X | Y | Z | X | Y | Z | X | Y | Z |
|---|---|---|---|---|---|---|---|---|
| −35.83 | 33.97 | 518.57 | 52.50 | −33.42 | 518.57 | 36.55 | −28.17 | 518.57 |
| −34.45 | 32.95 | 518.57 | 52.43 | −33.58 | 518.57 | 38.36 | −28.94 | 518.57 |
| −32.91 | 31.81 | 518.57 | −46.63 | 40.92 | 518.57 | 39.97 | −29.60 | 518.57 |
| −31.17 | 30.52 | 518.57 | −46.65 | 40.82 | 518.57 | 41.41 | −30.18 | 518.57 |
| −29.22 | 29.07 | 518.57 | −46.66 | 40.70 | 518.57 | 42.70 | −30.69 | 518.57 |
| −27.02 | 27.45 | 518.57 | −46.65 | 40.57 | 518.57 | 43.85 | −31.13 | 518.57 |
| −24.56 | 25.62 | 518.57 | −46.63 | 40.42 | 518.57 | 44.87 | −31.52 | 518.57 |
| −21.80 | 23.56 | 518.57 | −46.57 | 40.25 | 518.57 | 45.79 | −31.86 | 518.57 |
| −18.69 | 21.24 | 518.57 | −46.50 | 40.08 | 518.57 | 46.60 | −32.15 | 518.57 |
| −15.21 | 18.64 | 518.57 | −46.39 | 39.89 | 518.57 | 47.33 | −32.42 | 518.57 |
| −11.29 | 15.71 | 518.57 | −46.27 | 39.69 | 518.57 | 47.98 | −32.65 | 518.57 |
| −6.90 | 12.42 | 518.57 | −46.11 | 39.47 | 518.57 | 48.55 | −32.85 | 518.57 |
| −1.96 | 8.71 | 518.57 | −45.93 | 39.22 | 518.57 | 49.07 | −33.03 | 518.57 |
| 3.58 | 4.54 | 518.57 | −45.73 | 38.94 | 518.57 | 49.53 | −33.19 | 518.57 |
| 9.10 | 0.36 | 518.57 | −45.51 | 38.63 | 518.57 | 49.93 | −33.33 | 518.57 |
| 14.02 | −3.36 | 518.57 | −45.26 | 38.28 | 518.57 | 50.30 | −33.45 | 518.57 |
| 18.39 | −6.67 | 518.57 | −44.98 | 37.89 | 518.57 | 50.62 | −33.56 | 518.57 |
| 22.27 | −9.63 | 518.57 | −44.66 | 37.44 | 518.57 | 50.91 | −33.66 | 518.57 |
| 25.73 | −12.27 | 518.57 | −44.31 | 36.94 | 518.57 | 51.17 | −33.74 | 518.57 |
| 28.80 | −14.61 | 518.57 | −43.92 | 36.38 | 518.57 | 51.39 | −33.82 | 518.57 |
| 31.53 | −16.71 | 518.57 | −43.47 | 35.76 | 518.57 | 51.60 | −33.89 | 518.57 |
| 33.97 | −18.57 | 518.57 | −42.96 | 35.06 | 518.57 | 51.78 | −33.93 | 518.57 |
| 36.13 | −20.23 | 518.57 | −42.38 | 34.27 | 518.57 | 51.95 | −33.92 | 518.57 |
| 38.05 | −21.71 | 518.57 | −41.73 | 33.39 | 518.57 | 52.10 | −33.88 | 518.57 |
| 39.76 | −23.02 | 518.57 | −40.98 | 32.41 | 518.57 | 52.22 | −33.82 | 518.57 |
| 41.29 | −24.20 | 518.57 | −40.14 | 31.32 | 518.57 | 52.31 | −33.74 | 518.57 |
| | | | SECTION 8 Z = 543.97 | | | | | |
| −43.88 | 43.82 | 543.97 | 40.11 | −28.91 | 543.97 | −36.85 | 32.70 | 543.97 |
| −43.72 | 43.92 | 543.97 | 41.24 | −29.93 | 543.97 | −35.83 | 31.30 | 543.97 |
| −43.60 | 43.94 | 543.97 | 42.25 | −30.83 | 543.97 | −34.67 | 29.74 | 543.97 |
| −43.47 | 43.94 | 543.97 | 43.15 | −31.63 | 543.97 | −33.34 | 27.99 | 543.97 |
| −43.32 | 43.91 | 543.97 | 43.95 | −32.35 | 543.97 | −31.83 | 26.05 | 543.97 |
| −43.17 | 43.86 | 543.97 | 44.66 | −32.98 | 543.97 | −30.11 | 23.89 | 543.97 |
| −43.00 | 43.77 | 543.97 | 45.29 | −33.55 | 543.97 | −28.15 | 21.48 | 543.97 |
| −42.83 | 43.64 | 543.97 | 45.86 | −34.05 | 543.97 | −25.90 | 18.82 | 543.97 |
| −42.65 | 43.49 | 543.97 | 46.36 | −34.50 | 543.97 | −23.32 | 15.86 | 543.97 |
| −42.45 | 43.31 | 543.97 | 46.81 | −34.90 | 543.97 | −20.37 | 12.59 | 543.97 |
| −42.23 | 43.11 | 543.97 | 47.20 | −35.26 | 543.97 | −16.97 | 8.99 | 543.97 |
| −41.98 | 42.89 | 543.97 | 47.56 | −35.57 | 543.97 | −13.06 | 5.03 | 543.97 |
| −41.70 | 42.64 | 543.97 | 47.87 | −35.85 | 543.97 | −8.54 | 0.70 | 543.97 |
| −41.37 | 42.37 | 543.97 | 48.15 | −36.10 | 543.97 | −3.33 | −4.01 | 543.97 |
| −41.01 | 42.06 | 543.97 | 48.40 | −36.33 | 543.97 | 2.03 | −8.56 | 543.97 |
| −40.60 | 41.72 | 543.97 | 48.62 | −36.53 | 543.97 | 6.92 | −12.46 | 543.97 |
| −40.14 | 41.33 | 543.97 | 48.82 | −36.70 | 543.97 | 11.36 | −15.82 | 543.97 |
| −39.63 | 40.90 | 543.97 | 49.00 | −36.86 | 543.97 | 15.38 | −18.72 | 543.97 |
| −39.06 | 40.40 | 543.97 | 49.15 | −37.00 | 543.97 | 19.01 | −21.22 | 543.97 |
| −38.41 | 39.85 | 543.97 | 49.29 | −37.12 | 543.97 | 22.29 | −23.39 | 543.97 |
| −37.68 | 39.23 | 543.97 | 49.39 | −37.26 | 543.97 | 25.23 | −25.27 | 543.97 |
| −36.87 | 38.53 | 543.97 | 49.44 | −37.40 | 543.97 | 27.87 | −26.90 | 543.97 |
| −35.95 | 37.74 | 543.97 | 49.46 | −37.53 | 543.97 | 30.25 | −28.33 | 543.97 |
| −34.92 | 36.86 | 543.97 | 49.45 | −37.65 | 543.97 | 32.37 | −29.57 | 543.97 |
| −33.77 | 35.87 | 543.97 | 49.42 | −37.75 | 543.97 | 34.27 | −30.66 | 543.97 |
| −32.47 | 34.75 | 543.97 | 49.34 | −37.90 | 543.97 | 35.98 | −31.61 | 543.97 |
| −31.01 | 33.50 | 543.97 | −43.98 | 43.67 | 543.97 | 37.50 | −32.45 | 543.97 |
| −29.37 | 32.09 | 543.97 | −44.00 | 43.56 | 543.97 | 38.86 | −33.18 | 543.97 |
| −27.53 | 30.51 | 543.97 | −44.01 | 43.44 | 543.97 | 40.07 | −33.83 | 543.97 |
| −25.46 | 28.72 | 543.97 | −44.00 | 43.31 | 543.97 | 41.16 | −34.39 | 543.97 |
| −23.14 | 26.72 | 543.97 | −43.97 | 43.16 | 543.97 | 42.13 | −34.89 | 543.97 |
| −20.54 | 24.47 | 543.97 | −43.91 | 43.00 | 543.97 | 42.99 | −35.33 | 543.97 |
| −17.61 | 21.93 | 543.97 | −43.83 | 42.83 | 543.97 | 43.76 | −35.72 | 543.97 |
| −14.33 | 19.08 | 543.97 | −43.72 | 42.65 | 543.97 | 44.45 | −36.07 | 543.97 |
| −10.64 | 15.88 | 543.97 | −43.58 | 42.45 | 543.97 | 45.06 | −36.37 | 543.97 |
| −6.50 | 12.27 | 543.97 | −43.43 | 42.23 | 543.97 | 45.60 | −36.64 | 543.97 |
| −1.85 | 8.21 | 543.97 | −43.26 | 41.98 | 543.97 | 46.09 | −36.88 | 543.97 |
| 3.36 | 3.64 | 543.97 | −43.07 | 41.70 | 543.97 | 46.52 | −37.09 | 543.97 |
| 8.56 | −0.92 | 543.97 | −42.86 | 41.39 | 543.97 | 46.91 | −37.28 | 543.97 |
| 13.18 | −4.99 | 543.97 | −42.62 | 41.03 | 543.97 | 47.25 | −37.44 | 543.97 |
| 17.29 | −8.62 | 543.97 | −42.36 | 40.63 | 543.97 | 47.56 | −37.59 | 543.97 |
| 20.95 | −11.86 | 543.97 | −42.06 | 40.17 | 543.97 | 47.83 | −37.72 | 543.97 |
| 24.20 | −14.74 | 543.97 | −41.73 | 39.67 | 543.97 | 48.07 | −37.83 | 543.97 |
| 27.09 | −17.31 | 543.97 | −41.35 | 39.10 | 543.97 | 48.29 | −37.94 | 543.97 |
| 29.66 | −19.59 | 543.97 | −40.92 | 38.47 | 543.97 | 48.48 | −38.03 | 543.97 |
| 31.94 | −21.63 | 543.97 | −40.43 | 37.75 | 543.97 | 48.65 | −38.11 | 543.97 |
| 33.98 | −23.44 | 543.97 | −39.88 | 36.96 | 543.97 | 48.82 | −38.15 | 543.97 |
| 35.79 | −25.06 | 543.97 | −39.26 | 36.07 | 543.97 | 48.97 | −38.14 | 543.97 |
| 37.40 | −26.49 | 543.97 | −38.55 | 35.07 | 543.97 | 49.10 | −38.11 | 543.97 |
| 38.83 | −27.77 | 543.97 | −37.76 | 33.95 | 543.97 | 49.20 | −38.05 | 543.97 |

TABLE 1-continued

| X | Y | Z | X | Y | Z | X | Y | Z |
|---|---|---|---|---|---|---|---|---|
| | | | SECTION 9 Z = 569.37 | | | | | |
| −41.44 | 46.07 | 569.37 | 37.57 | −31.98 | 569.37 | −34.60 | 34.88 | 569.37 |
| −41.27 | 46.15 | 569.37 | 38.64 | −33.06 | 569.37 | −33.61 | 33.47 | 569.37 |
| −41.15 | 46.16 | 569.37 | 39.60 | −34.02 | 569.37 | −32.50 | 31.88 | 569.37 |
| −41.02 | 46.14 | 569.37 | 40.45 | −34.87 | 569.37 | −31.23 | 30.11 | 569.37 |
| −40.88 | 46.08 | 569.37 | 41.21 | −35.63 | 569.37 | −29.78 | 28.14 | 569.37 |
| −40.74 | 46.00 | 569.37 | 41.89 | −36.30 | 569.37 | −28.14 | 25.93 | 569.37 |
| −40.59 | 45.88 | 569.37 | 42.49 | −36.90 | 569.37 | −26.27 | 23.48 | 569.37 |
| −40.44 | 45.74 | 569.37 | 43.02 | −37.44 | 569.37 | −24.14 | 20.74 | 569.37 |
| −40.27 | 45.57 | 569.37 | 43.50 | −37.91 | 569.37 | −21.69 | 17.70 | 569.37 |
| −40.09 | 45.38 | 569.37 | 43.92 | −38.33 | 569.37 | −18.90 | 14.33 | 569.37 |
| −39.88 | 45.16 | 569.37 | 44.30 | −38.71 | 569.37 | −15.69 | 10.59 | 569.37 |
| −39.65 | 44.93 | 569.37 | 44.63 | −39.04 | 569.37 | −12.00 | 6.46 | 569.37 |
| −39.38 | 44.66 | 569.37 | 44.93 | −39.34 | 569.37 | −7.77 | 1.92 | 569.37 |
| −39.08 | 44.37 | 569.37 | 45.20 | −39.61 | 569.37 | −2.88 | −3.07 | 569.37 |
| −38.74 | 44.04 | 569.37 | 45.43 | −39.84 | 569.37 | 2.14 | −7.94 | 569.37 |
| −38.35 | 43.66 | 569.37 | 45.64 | −40.06 | 569.37 | 6.72 | −12.16 | 569.37 |
| −37.93 | 43.24 | 569.37 | 45.83 | −40.24 | 569.37 | 10.87 | −15.83 | 569.37 |
| −37.45 | 42.77 | 569.37 | 46.00 | −40.41 | 569.37 | 14.62 | −19.02 | 569.37 |
| −36.91 | 42.24 | 569.37 | 46.15 | −40.56 | 569.37 | 18.02 | −21.80 | 569.37 |
| −36.30 | 41.64 | 569.37 | 46.28 | −40.69 | 569.37 | 21.07 | −24.24 | 569.37 |
| −35.63 | 40.97 | 569.37 | 46.39 | −40.81 | 569.37 | 23.82 | −26.37 | 569.37 |
| −34.86 | 40.21 | 569.37 | 46.46 | −40.94 | 569.37 | 26.29 | −28.23 | 569.37 |
| −34.01 | 39.37 | 569.37 | 46.49 | −41.07 | 569.37 | 28.50 | −29.87 | 569.37 |
| −33.04 | 38.41 | 569.37 | 46.49 | −41.19 | 569.37 | 30.48 | −31.31 | 569.37 |
| −31.96 | 37.34 | 569.37 | 46.46 | −41.29 | 569.37 | 32.26 | −32.57 | 569.37 |
| −30.74 | 36.14 | 569.37 | 46.37 | −41.44 | 569.37 | 33.85 | −33.69 | 569.37 |
| −29.37 | 34.79 | 569.37 | −41.54 | 45.92 | 569.37 | 35.27 | −34.67 | 569.37 |
| −27.84 | 33.27 | 569.37 | −41.56 | 45.81 | 569.37 | 36.54 | −35.54 | 569.37 |
| −26.12 | 31.56 | 569.37 | −41.56 | 45.69 | 569.37 | 37.67 | −36.30 | 569.37 |
| −24.18 | 29.64 | 569.37 | −41.55 | 45.56 | 569.37 | 38.68 | −36.98 | 569.37 |
| −22.01 | 27.48 | 569.37 | −41.50 | 45.42 | 569.37 | 39.58 | −37.58 | 569.37 |
| −19.56 | 25.06 | 569.37 | −41.43 | 45.26 | 569.37 | 40.39 | −38.11 | 569.37 |
| −16.82 | 22.33 | 569.37 | −41.34 | 45.10 | 569.37 | 41.11 | −38.58 | 569.37 |
| −13.74 | 19.27 | 569.37 | −41.23 | 44.92 | 569.37 | 41.75 | −38.99 | 569.37 |
| −10.27 | 15.83 | 569.37 | −41.09 | 44.73 | 569.37 | 42.32 | −39.36 | 569.37 |
| −6.38 | 11.96 | 569.37 | −40.94 | 44.50 | 569.37 | 42.83 | −39.69 | 569.37 |
| −2.02 | 7.61 | 569.37 | −40.78 | 44.25 | 569.37 | 43.28 | −39.98 | 569.37 |
| 2.89 | 2.71 | 569.37 | −40.60 | 43.97 | 569.37 | 43.69 | −40.24 | 569.37 |
| 7.78 | −2.17 | 569.37 | −40.40 | 43.65 | 569.37 | 44.05 | −40.46 | 569.37 |
| 12.14 | −6.52 | 569.37 | −40.17 | 43.29 | 569.37 | 44.37 | −40.67 | 569.37 |
| 16.01 | −10.40 | 569.37 | −39.91 | 42.88 | 569.37 | 44.66 | −40.85 | 569.37 |
| 19.46 | −13.85 | 569.37 | −39.62 | 42.43 | 569.37 | 44.91 | −41.01 | 569.37 |
| 22.53 | −16.92 | 569.37 | −39.30 | 41.92 | 569.37 | 45.14 | −41.15 | 569.37 |
| 25.25 | −19.65 | 569.37 | −38.93 | 41.35 | 569.37 | 45.34 | −41.27 | 569.37 |
| 27.68 | −22.08 | 569.37 | −38.51 | 40.71 | 569.37 | 45.52 | −41.39 | 569.37 |
| 29.85 | −24.25 | 569.37 | −38.04 | 39.99 | 569.37 | 45.68 | −41.49 | 569.37 |
| 31.77 | −26.18 | 569.37 | −37.51 | 39.19 | 569.37 | 45.82 | −41.57 | 569.37 |
| 33.48 | −27.89 | 569.37 | −36.91 | 38.29 | 569.37 | 45.97 | −41.61 | 569.37 |
| 35.01 | −29.42 | 569.37 | −36.23 | 37.28 | 569.37 | 46.10 | −41.60 | 569.37 |
| 36.36 | −30.78 | 569.37 | −35.46 | 36.15 | 569.37 | 46.22 | −41.56 | 569.37 |
| | | | SECTION 10 Z = 589.69 | | | | | |
| −39.67 | 47.56 | 589.69 | 35.63 | −34.04 | 589.69 | −32.91 | 36.36 | 589.69 |
| −39.49 | 47.64 | 589.69 | 36.66 | −35.15 | 589.69 | −31.95 | 34.93 | 589.69 |
| −39.37 | 47.63 | 589.69 | 37.58 | −36.14 | 589.69 | −30.86 | 33.34 | 589.69 |
| −39.25 | 47.59 | 589.69 | 38.40 | −37.03 | 589.69 | −29.63 | 31.55 | 589.69 |
| −39.12 | 47.51 | 589.69 | 39.13 | −37.81 | 589.69 | −28.23 | 29.56 | 589.69 |
| −38.99 | 47.41 | 589.69 | 39.78 | −38.51 | 589.69 | −26.64 | 27.33 | 589.69 |
| −38.85 | 47.28 | 589.69 | 40.35 | −39.13 | 589.69 | −24.83 | 24.84 | 589.69 |
| −38.71 | 47.12 | 589.69 | 40.87 | −39.69 | 589.69 | −22.76 | 22.06 | 589.69 |
| −38.56 | 46.94 | 589.69 | 41.32 | −40.18 | 589.69 | −20.41 | 18.97 | 589.69 |
| −38.38 | 46.75 | 589.69 | 41.73 | −40.62 | 589.69 | −17.72 | 15.52 | 589.69 |
| −38.19 | 46.52 | 589.69 | 42.09 | −41.01 | 589.69 | −14.65 | 11.70 | 589.69 |
| −37.96 | 46.27 | 589.69 | 42.42 | −41.36 | 589.69 | −11.12 | 7.46 | 589.69 |
| −37.71 | 46.00 | 589.69 | 42.70 | −41.67 | 589.69 | −7.08 | 2.77 | 589.69 |
| −37.42 | 45.69 | 589.69 | 42.96 | −41.94 | 589.69 | −2.42 | −2.40 | 589.69 |
| −37.10 | 45.34 | 589.69 | 43.19 | −42.19 | 589.69 | 2.35 | −7.48 | 589.69 |
| −36.74 | 44.94 | 589.69 | 43.39 | −42.40 | 589.69 | 6.68 | −11.92 | 589.69 |
| −36.34 | 44.50 | 589.69 | 43.57 | −42.60 | 589.69 | 10.61 | −15.79 | 589.69 |
| −35.88 | 44.00 | 589.69 | 43.73 | −42.77 | 589.69 | 14.16 | −19.19 | 589.69 |
| −35.37 | 43.45 | 589.69 | 43.87 | −42.92 | 589.69 | 17.37 | −22.16 | 589.69 |
| −34.80 | 42.82 | 589.69 | 44.00 | −43.06 | 589.69 | 20.25 | −24.77 | 589.69 |
| −34.16 | 42.11 | 589.69 | 44.11 | −43.18 | 589.69 | 22.85 | −27.07 | 589.69 |
| −33.44 | 41.32 | 589.69 | 44.20 | −43.30 | 589.69 | 25.17 | −29.09 | 589.69 |
| −32.63 | 40.43 | 589.69 | 44.24 | −43.42 | 589.69 | 27.26 | −30.87 | 589.69 |
| −31.71 | 39.43 | 589.69 | 44.25 | −43.54 | 589.69 | 29.13 | −32.44 | 589.69 |

TABLE 1-continued

| X | Y | Z | X | Y | Z | X | Y | Z |
|---|---|---|---|---|---|---|---|---|
| −30.69 | 38.30 | 589.69 | 44.22 | −43.64 | 589.69 | 30.80 | −33.82 | 589.69 |
| −29.54 | 37.04 | 589.69 | 44.13 | −43.79 | 589.69 | 32.30 | −35.05 | 589.69 |
| −28.24 | 35.62 | 589.69 | −39.76 | 47.41 | 589.69 | 33.64 | −36.13 | 589.69 |
| −26.79 | 34.02 | 589.69 | −39.78 | 47.31 | 589.69 | 34.84 | −37.09 | 589.69 |
| −25.15 | 32.23 | 589.69 | −39.77 | 47.19 | 589.69 | 35.90 | −37.93 | 589.69 |
| −23.32 | 30.22 | 589.69 | −39.74 | 47.06 | 589.69 | 36.86 | −38.68 | 589.69 |
| −21.25 | 27.95 | 589.69 | −39.69 | 46.92 | 589.69 | 37.71 | −39.35 | 589.69 |
| −18.93 | 25.41 | 589.69 | −39.61 | 46.77 | 589.69 | 38.47 | −39.94 | 589.69 |
| −16.33 | 22.56 | 589.69 | −39.51 | 46.61 | 589.69 | 39.15 | −40.46 | 589.69 |
| −13.40 | 19.35 | 589.69 | −39.40 | 46.44 | 589.69 | 39.75 | −40.92 | 589.69 |
| −10.10 | 15.75 | 589.69 | −39.27 | 46.24 | 589.69 | 40.29 | −41.34 | 589.69 |
| −6.40 | 11.70 | 589.69 | −39.13 | 46.01 | 589.69 | 40.77 | −41.70 | 589.69 |
| −2.24 | 7.16 | 589.69 | −38.97 | 45.76 | 589.69 | 41.19 | −42.02 | 589.69 |
| 2.43 | 2.05 | 589.69 | −38.79 | 45.48 | 589.69 | 41.58 | −42.31 | 589.69 |
| 7.10 | −3.05 | 589.69 | −38.59 | 45.16 | 589.69 | 41.92 | −42.57 | 589.69 |
| 11.26 | −7.58 | 589.69 | −38.36 | 44.80 | 589.69 | 42.22 | −42.80 | 589.69 |
| 14.97 | −11.61 | 589.69 | −38.11 | 44.39 | 589.69 | 42.49 | −43.00 | 589.69 |
| 18.26 | −15.20 | 589.69 | −37.83 | 43.94 | 589.69 | 42.73 | −43.18 | 589.69 |
| 21.20 | −18.39 | 589.69 | −37.51 | 43.43 | 589.69 | 42.94 | −43.34 | 589.69 |
| 23.82 | −21.23 | 589.69 | −37.14 | 42.86 | 589.69 | 43.13 | −43.48 | 589.69 |
| 26.14 | −23.76 | 589.69 | −36.74 | 42.21 | 589.69 | 43.30 | −43.61 | 589.69 |
| 28.22 | −26.01 | 589.69 | −36.27 | 41.49 | 589.69 | 43.45 | −43.72 | 589.69 |
| 30.06 | −28.01 | 589.69 | −35.75 | 40.69 | 589.69 | 43.58 | −43.82 | 589.69 |
| 31.71 | −29.79 | 589.69 | −35.17 | 39.78 | 589.69 | 43.71 | −43.89 | 589.69 |
| 33.17 | −31.37 | 589.69 | −34.50 | 38.77 | 589.69 | 43.85 | −43.91 | 589.69 |
| 34.47 | −32.78 | 589.69 | −33.75 | 37.63 | 589.69 | 43.96 | −43.90 | 589.69 |
| | | | SECTION 11 Z = 610.01 | | | | | |
| −38.07 | 48.83 | 610.01 | 33.82 | −35.76 | 610.01 | −31.37 | 37.60 | 610.01 |
| −37.88 | 48.88 | 610.01 | 34.81 | −36.91 | 610.01 | −30.43 | 36.16 | 610.01 |
| −37.77 | 48.85 | 610.01 | 35.69 | −37.94 | 610.01 | −29.37 | 34.55 | 610.01 |
| −37.65 | 48.79 | 610.01 | 36.48 | −38.85 | 610.01 | −28.17 | 32.75 | 610.01 |
| −37.53 | 48.70 | 610.01 | 37.18 | −39.66 | 610.01 | −26.81 | 30.74 | 610.01 |
| −37.42 | 48.58 | 610.01 | 37.80 | −40.38 | 610.01 | −25.26 | 28.48 | 610.01 |
| −37.30 | 48.44 | 610.01 | 38.35 | −41.02 | 610.01 | −23.51 | 25.97 | 610.01 |
| −37.17 | 48.27 | 610.01 | 38.85 | −41.59 | 610.01 | −21.51 | 23.15 | 610.01 |
| −37.02 | 48.09 | 610.01 | 39.28 | −42.10 | 610.01 | −19.24 | 20.01 | 610.01 |
| −36.85 | 47.89 | 610.01 | 39.67 | −42.56 | 610.01 | −16.65 | 16.51 | 610.01 |
| −36.66 | 47.66 | 610.01 | 40.02 | −42.96 | 610.01 | −13.69 | 12.61 | 610.01 |
| −36.45 | 47.40 | 610.01 | 40.33 | −43.32 | 610.01 | −10.31 | 8.28 | 610.01 |
| −36.21 | 47.11 | 610.01 | 40.61 | −43.64 | 610.01 | −6.44 | 3.46 | 610.01 |
| −35.94 | 46.78 | 610.01 | 40.85 | −43.92 | 610.01 | −2.00 | −1.87 | 610.01 |
| −35.63 | 46.42 | 610.01 | 41.07 | −44.17 | 610.01 | 2.54 | −7.13 | 610.01 |
| −35.29 | 46.01 | 610.01 | 41.27 | −44.40 | 610.01 | 6.66 | −11.75 | 610.01 |
| −34.91 | 45.55 | 610.01 | 41.44 | −44.60 | 610.01 | 10.38 | −15.80 | 610.01 |
| −34.48 | 45.04 | 610.01 | 41.59 | −44.77 | 610.01 | 13.75 | −19.36 | 610.01 |
| −33.99 | 44.45 | 610.01 | 41.73 | −44.93 | 610.01 | 16.78 | −22.50 | 610.01 |
| −33.45 | 43.80 | 610.01 | 41.85 | −45.08 | 610.01 | 19.50 | −25.26 | 610.01 |
| −32.84 | 43.07 | 610.01 | 41.96 | −45.20 | 610.01 | 21.95 | −27.70 | 610.01 |
| −32.16 | 42.24 | 610.01 | 42.06 | −45.31 | 610.01 | 24.15 | −29.85 | 610.01 |
| −31.38 | 41.32 | 610.01 | 42.12 | −45.43 | 610.01 | 26.12 | −31.74 | 610.01 |
| −30.52 | 40.28 | 610.01 | 42.14 | −45.54 | 610.01 | 27.88 | −33.42 | 610.01 |
| −29.54 | 39.11 | 610.01 | 42.12 | −45.64 | 610.01 | 29.46 | −34.91 | 610.01 |
| −28.45 | 37.80 | 610.01 | 42.03 | −45.79 | 610.01 | 30.87 | −36.22 | 610.01 |
| −27.22 | 36.32 | 610.01 | −38.15 | 48.68 | 610.01 | 32.14 | −37.38 | 610.01 |
| −25.84 | 34.67 | 610.01 | −38.16 | 48.57 | 610.01 | 33.26 | −38.42 | 610.01 |
| −24.28 | 32.80 | 610.01 | −38.14 | 48.45 | 610.01 | 34.27 | −39.33 | 610.01 |
| −22.54 | 30.71 | 610.01 | −38.10 | 48.33 | 610.01 | 35.17 | −40.14 | 610.01 |
| −20.57 | 28.37 | 610.01 | −38.04 | 48.19 | 610.01 | 35.97 | −40.86 | 610.01 |
| −18.37 | 25.73 | 610.01 | −37.95 | 48.05 | 610.01 | 36.69 | −41.50 | 610.01 |
| −15.89 | 22.77 | 610.01 | −37.85 | 47.89 | 610.01 | 37.32 | −42.06 | 610.01 |
| −13.09 | 19.44 | 610.01 | −37.74 | 47.71 | 610.01 | 37.89 | −42.57 | 610.01 |
| −9.96 | 15.71 | 610.01 | −37.61 | 47.51 | 610.01 | 38.40 | −43.01 | 610.01 |
| −6.43 | 11.52 | 610.01 | −37.47 | 47.29 | 610.01 | 38.85 | −43.41 | 610.01 |
| −2.46 | 6.81 | 610.01 | −37.32 | 47.03 | 610.01 | 39.25 | −43.76 | 610.01 |
| 2.01 | 1.52 | 610.01 | −37.14 | 46.75 | 610.01 | 39.61 | −44.08 | 610.01 |
| 6.48 | −3.75 | 610.01 | −36.94 | 46.43 | 610.01 | 39.93 | −44.36 | 610.01 |
| 10.45 | −8.44 | 610.01 | −36.72 | 46.07 | 610.01 | 40.22 | −44.60 | 610.01 |
| 14.00 | −12.61 | 610.01 | −36.47 | 45.66 | 610.01 | 40.47 | −44.82 | 610.01 |
| 17.16 | −16.32 | 610.01 | −36.19 | 45.21 | 610.01 | 40.70 | −45.02 | 610.01 |
| 19.97 | −19.61 | 610.01 | −35.88 | 44.69 | 610.01 | 40.90 | −45.19 | 610.01 |
| 22.48 | −22.55 | 610.01 | −35.52 | 44.12 | 610.01 | 41.08 | −45.35 | 610.01 |
| 24.71 | −25.16 | 610.01 | −35.12 | 43.48 | 610.01 | 41.24 | −45.49 | 610.01 |
| 26.70 | −27.48 | 610.01 | −34.67 | 42.76 | 610.01 | 41.38 | −45.61 | 610.01 |
| 28.47 | −29.54 | 610.01 | −34.16 | 41.95 | 610.01 | 41.50 | −45.72 | 610.01 |
| 30.05 | −31.38 | 610.01 | −33.58 | 41.04 | 610.01 | 41.62 | −45.81 | 610.01 |
| 31.45 | −33.01 | 610.01 | −32.93 | 40.02 | 610.01 | 41.74 | −45.87 | 610.01 |
| 32.70 | −34.47 | 610.01 | −32.20 | 38.88 | 610.01 | 41.85 | −45.88 | 610.01 |

TABLE 1-continued

| X | Y | Z | X | Y | Z | X | Y | Z |
|---|---|---|---|---|---|---|---|---|
| | | | SECTION 12 Z = 622.71 | | | | | |
| −37.18 | 49.49 | 622.71 | 32.76 | −36.69 | 622.71 | −30.51 | 38.25 | 622.71 |
| −36.99 | 49.53 | 622.71 | 33.73 | −37.86 | 622.71 | −29.58 | 36.81 | 622.71 |
| −36.88 | 49.49 | 622.71 | 34.59 | −38.90 | 622.71 | −28.54 | 35.19 | 622.71 |
| −36.77 | 49.42 | 622.71 | 35.36 | −39.82 | 622.71 | −27.35 | 33.38 | 622.71 |
| −36.66 | 49.32 | 622.71 | 36.04 | −40.65 | 622.71 | −26.01 | 31.36 | 622.71 |
| −36.56 | 49.19 | 622.71 | 36.65 | −41.38 | 622.71 | −24.49 | 29.10 | 622.71 |
| −36.44 | 49.04 | 622.71 | 37.19 | −42.04 | 622.71 | −22.77 | 26.56 | 622.71 |
| −36.31 | 48.88 | 622.71 | 37.67 | −42.62 | 622.71 | −20.81 | 23.73 | 622.71 |
| −36.17 | 48.69 | 622.71 | 38.10 | −43.14 | 622.71 | −18.58 | 20.56 | 622.71 |
| −36.01 | 48.48 | 622.71 | 38.48 | −43.60 | 622.71 | −16.04 | 17.03 | 622.71 |
| −35.82 | 48.25 | 622.71 | 38.82 | −44.00 | 622.71 | −13.15 | 13.09 | 622.71 |
| −35.62 | 47.98 | 622.71 | 39.12 | −44.37 | 622.71 | −9.85 | 8.71 | 622.71 |
| −35.38 | 47.69 | 622.71 | 39.39 | −44.69 | 622.71 | −6.08 | 3.83 | 622.71 |
| −35.12 | 47.36 | 622.71 | 39.63 | −44.98 | 622.71 | −1.76 | −1.59 | 622.71 |
| −34.83 | 46.99 | 622.71 | 39.85 | −45.24 | 622.71 | 2.65 | −6.95 | 622.71 |
| −34.49 | 46.57 | 622.71 | 40.04 | −45.47 | 622.71 | 6.65 | −11.66 | 622.71 |
| −34.12 | 46.10 | 622.71 | 40.20 | −45.67 | 622.71 | 10.26 | −15.81 | 622.71 |
| −33.70 | 45.58 | 622.71 | 40.35 | −45.85 | 622.71 | 13.52 | −19.46 | 622.71 |
| −33.24 | 44.98 | 622.71 | 40.49 | −46.01 | 622.71 | 16.45 | −22.68 | 622.71 |
| −32.71 | 44.32 | 622.71 | 40.61 | −46.16 | 622.71 | 19.08 | −25.52 | 622.71 |
| −32.12 | 43.57 | 622.71 | 40.71 | −46.28 | 622.71 | 21.45 | −28.03 | 622.71 |
| −31.45 | 42.73 | 622.71 | 40.81 | −46.40 | 622.71 | 23.57 | −30.25 | 622.71 |
| −30.70 | 41.79 | 622.71 | 40.89 | −46.50 | 622.71 | 25.47 | −32.21 | 622.71 |
| −29.86 | 40.73 | 622.71 | 40.92 | −46.61 | 622.71 | 27.17 | −33.95 | 622.71 |
| −28.92 | 39.54 | 622.71 | 40.91 | −46.72 | 622.71 | 28.70 | −35.49 | 622.71 |
| −27.85 | 38.20 | 622.71 | 40.81 | −46.86 | 622.71 | 30.06 | −36.85 | 622.71 |
| −26.66 | 36.69 | 622.71 | −37.26 | 49.34 | 622.71 | 31.28 | −38.05 | 622.71 |
| −25.32 | 35.01 | 622.71 | −37.26 | 49.23 | 622.71 | 32.36 | −39.13 | 622.71 |
| −23.81 | 33.11 | 622.71 | −37.23 | 49.12 | 622.71 | 33.33 | −40.07 | 622.71 |
| −22.11 | 30.98 | 622.71 | −37.18 | 49.00 | 622.71 | 34.20 | −40.92 | 622.71 |
| −20.20 | 28.59 | 622.71 | −37.11 | 48.87 | 622.71 | 34.97 | −41.67 | 622.71 |
| −18.06 | 25.90 | 622.71 | −37.02 | 48.72 | 622.71 | 35.66 | −42.33 | 622.71 |
| −15.65 | 22.89 | 622.71 | −36.93 | 48.56 | 622.71 | 36.28 | −42.92 | 622.71 |
| −12.93 | 19.50 | 622.71 | −36.81 | 48.39 | 622.71 | 36.82 | −43.44 | 622.71 |
| −9.88 | 15.70 | 622.71 | −36.69 | 48.18 | 622.71 | 37.31 | −43.91 | 622.71 |
| −6.45 | 11.43 | 622.71 | −36.55 | 47.96 | 622.71 | 37.75 | −44.32 | 622.71 |
| −2.58 | 6.63 | 622.71 | −36.40 | 47.70 | 622.71 | 38.14 | −44.69 | 622.71 |
| 1.76 | 1.25 | 622.71 | −36.22 | 47.42 | 622.71 | 38.48 | −45.02 | 622.71 |
| 6.11 | −4.12 | 622.71 | −36.03 | 47.10 | 622.71 | 38.79 | −45.31 | 622.71 |
| 9.99 | −8.89 | 622.71 | −35.81 | 46.74 | 622.71 | 39.06 | −45.57 | 622.71 |
| 13.44 | −13.13 | 622.71 | −35.56 | 46.33 | 622.71 | 39.31 | −45.80 | 622.71 |
| 16.52 | −16.90 | 622.71 | −35.28 | 45.87 | 622.71 | 39.52 | −46.00 | 622.71 |
| 19.26 | −20.26 | 622.71 | −34.97 | 45.36 | 622.71 | 39.72 | −46.18 | 622.71 |
| 21.71 | −23.24 | 622.71 | −34.62 | 44.79 | 622.71 | 39.89 | −46.34 | 622.71 |
| 23.88 | −25.90 | 622.71 | −34.22 | 44.14 | 622.71 | 40.04 | −46.49 | 622.71 |
| 25.82 | −28.26 | 622.71 | −33.77 | 43.42 | 622.71 | 40.18 | −46.62 | 622.71 |
| 27.55 | −30.36 | 622.71 | −33.26 | 42.61 | 622.71 | 40.30 | −46.73 | 622.71 |
| 29.09 | −32.23 | 622.71 | −32.69 | 41.70 | 622.71 | 40.41 | −46.83 | 622.71 |
| 30.46 | −33.89 | 622.71 | −32.05 | 40.68 | 622.71 | 40.52 | −46.91 | 622.71 |
| 31.68 | −35.37 | 622.71 | −31.33 | 39.53 | 622.71 | 40.63 | −46.93 | 622.71 |
| | | | SECTION 13 Z = 627.79 | | | | | |
| −36.85 | 49.73 | 627.79 | 32.37 | −37.03 | 627.79 | −30.19 | 38.48 | 627.79 |
| −36.66 | 49.76 | 627.79 | 33.32 | −38.20 | 627.79 | −29.27 | 37.04 | 627.79 |
| −36.56 | 49.72 | 627.79 | 34.18 | −39.25 | 627.79 | −28.23 | 35.43 | 627.79 |
| −36.45 | 49.64 | 627.79 | 34.94 | −40.19 | 627.79 | −27.05 | 33.61 | 627.79 |
| −36.35 | 49.54 | 627.79 | 35.61 | −41.02 | 627.79 | −25.71 | 31.59 | 627.79 |
| −36.24 | 49.41 | 627.79 | 36.21 | −41.75 | 627.79 | −24.20 | 29.32 | 627.79 |
| −36.13 | 49.26 | 627.79 | 36.75 | −42.41 | 627.79 | −22.49 | 26.78 | 627.79 |
| −36.00 | 49.09 | 627.79 | 37.23 | −43.00 | 627.79 | −20.54 | 23.94 | 627.79 |
| −35.86 | 48.90 | 627.79 | 37.65 | −43.52 | 627.79 | −18.33 | 20.77 | 627.79 |
| −35.70 | 48.69 | 627.79 | 38.03 | −43.98 | 627.79 | −15.81 | 17.22 | 627.79 |
| −35.52 | 48.46 | 627.79 | 38.36 | −44.39 | 627.79 | −12.94 | 13.27 | 627.79 |
| −35.31 | 48.19 | 627.79 | 38.66 | −44.76 | 627.79 | −9.67 | 8.86 | 627.79 |
| −35.08 | 47.90 | 627.79 | 38.93 | −45.08 | 627.79 | −5.93 | 3.96 | 627.79 |
| −34.82 | 47.56 | 627.79 | 39.17 | −45.38 | 627.79 | −1.66 | −1.49 | 627.79 |
| −34.53 | 47.19 | 627.79 | 39.38 | −45.63 | 627.79 | 2.70 | −6.88 | 627.79 |
| −34.20 | 46.77 | 627.79 | 39.57 | −45.86 | 627.79 | 6.65 | −11.63 | 627.79 |
| −33.84 | 46.30 | 627.79 | 39.73 | −46.07 | 627.79 | 10.22 | −15.81 | 627.79 |
| −33.42 | 45.77 | 627.79 | 39.88 | −46.25 | 627.79 | 13.43 | −19.49 | 627.79 |
| −32.96 | 45.17 | 627.79 | 40.02 | −46.41 | 627.79 | 16.33 | −22.74 | 627.79 |
| −32.44 | 44.50 | 627.79 | 40.14 | −46.56 | 627.79 | 18.93 | −25.62 | 627.79 |
| −31.85 | 43.75 | 627.79 | 40.24 | −46.68 | 627.79 | 21.26 | −28.15 | 627.79 |
| −31.19 | 42.90 | 627.79 | 40.33 | −46.80 | 627.79 | 23.36 | −30.40 | 627.79 |
| −30.45 | 41.95 | 627.79 | 40.41 | −46.90 | 627.79 | 25.23 | −32.38 | 627.79 |
| −29.62 | 40.88 | 627.79 | 40.45 | −47.01 | 627.79 | 26.91 | −34.14 | 627.79 |

TABLE 1-continued

| X | Y | Z | X | Y | Z | X | Y | Z |
|---|---|---|---|---|---|---|---|---|
| −28.69 | 39.69 | 627.79 | 40.44 | −47.12 | 627.79 | 28.41 | −35.69 | 627.79 |
| −27.64 | 38.34 | 627.79 | 40.35 | −47.26 | 627.79 | 29.75 | −37.07 | 627.79 |
| −26.46 | 36.83 | 627.79 | −36.93 | 49.58 | 627.79 | 30.95 | −38.30 | 627.79 |
| −25.13 | 35.13 | 627.79 | −36.92 | 49.47 | 627.79 | 32.02 | −39.38 | 627.79 |
| −23.64 | 33.22 | 627.79 | −36.90 | 49.36 | 627.79 | 32.98 | −40.35 | 627.79 |
| −21.96 | 31.07 | 627.79 | −36.84 | 49.23 | 627.79 | 33.83 | −41.20 | 627.79 |
| −20.07 | 28.66 | 627.79 | −36.77 | 49.11 | 627.79 | 34.60 | −41.96 | 627.79 |
| −17.95 | 25.96 | 627.79 | −36.68 | 48.96 | 627.79 | 35.27 | −42.63 | 627.79 |
| −15.56 | 22.92 | 627.79 | −36.58 | 48.81 | 627.79 | 35.88 | −43.23 | 627.79 |
| −12.88 | 19.51 | 627.79 | −36.47 | 48.63 | 627.79 | 36.42 | −43.76 | 627.79 |
| −9.86 | 15.69 | 627.79 | −36.35 | 48.43 | 627.79 | 36.90 | −44.24 | 627.79 |
| −6.46 | 11.39 | 627.79 | −36.21 | 48.20 | 627.79 | 37.33 | −44.66 | 627.79 |
| −2.64 | 6.56 | 627.79 | −36.06 | 47.95 | 627.79 | 37.71 | −45.03 | 627.79 |
| 1.66 | 1.15 | 627.79 | −35.88 | 47.66 | 627.79 | 38.05 | −45.36 | 627.79 |
| 5.97 | −4.25 | 627.79 | −35.69 | 47.34 | 627.79 | 38.35 | −45.66 | 627.79 |
| 9.81 | −9.05 | 627.79 | −35.47 | 46.98 | 627.79 | 38.63 | −45.92 | 627.79 |
| 13.23 | −13.32 | 627.79 | −35.22 | 46.57 | 627.79 | 38.87 | −46.15 | 627.79 |
| 16.28 | −17.12 | 627.79 | −34.95 | 46.11 | 627.79 | 39.08 | −46.36 | 627.79 |
| 18.99 | −20.50 | 627.79 | −34.63 | 45.60 | 627.79 | 39.27 | −46.55 | 627.79 |
| 21.41 | −23.50 | 627.79 | −34.28 | 45.03 | 627.79 | 39.44 | −46.71 | 627.79 |
| 23.57 | −26.17 | 627.79 | −33.88 | 44.38 | 627.79 | 39.59 | −46.86 | 627.79 |
| 25.49 | −28.55 | 627.79 | −33.44 | 43.66 | 627.79 | 39.73 | −46.99 | 627.79 |
| 27.20 | −30.66 | 627.79 | −32.93 | 42.85 | 627.79 | 39.85 | −47.10 | 627.79 |
| 28.73 | −32.54 | 627.79 | −32.37 | 41.94 | 627.79 | 39.95 | −47.21 | 627.79 |
| 30.08 | −34.21 | 627.79 | −31.73 | 40.92 | 627.79 | 40.05 | −47.29 | 627.79 |
| 31.29 | −35.70 | 627.79 | −31.00 | 39.77 | 627.79 | 40.17 | −47.32 | 627.79 |
| | | | SECTION 14 Z = 632.87 | | | | | |
| −36.54 | 49.96 | 632.87 | 31.97 | −37.36 | 632.87 | −29.88 | 38.71 | 632.87 |
| −36.35 | 49.98 | 632.87 | 32.92 | −38.55 | 632.87 | −28.96 | 37.26 | 632.87 |
| −36.24 | 49.94 | 632.87 | 33.76 | −39.60 | 632.87 | −27.92 | 35.65 | 632.87 |
| −36.14 | 49.85 | 632.87 | 34.52 | −40.54 | 632.87 | −26.75 | 33.83 | 632.87 |
| −36.04 | 49.74 | 632.87 | 35.18 | −41.38 | 632.87 | −25.42 | 31.80 | 632.87 |
| −35.94 | 49.61 | 632.87 | 35.78 | −42.12 | 632.87 | −23.92 | 29.53 | 632.87 |
| −35.83 | 49.46 | 632.87 | 36.31 | −42.78 | 632.87 | −22.21 | 26.99 | 632.87 |
| −35.70 | 49.29 | 632.87 | 36.78 | −43.37 | 632.87 | −20.28 | 24.14 | 632.87 |
| −35.56 | 49.10 | 632.87 | 37.20 | −43.90 | 632.87 | −18.08 | 20.96 | 632.87 |
| −35.40 | 48.89 | 632.87 | 37.58 | −44.36 | 632.87 | −15.58 | 17.40 | 632.87 |
| −35.22 | 48.66 | 632.87 | 37.91 | −44.78 | 632.87 | −12.74 | 13.44 | 632.87 |
| −35.02 | 48.39 | 632.87 | 38.20 | −45.15 | 632.87 | −9.49 | 9.01 | 632.87 |
| −34.79 | 48.09 | 632.87 | 38.47 | −45.47 | 632.87 | −5.79 | 4.09 | 632.87 |
| −34.54 | 47.76 | 632.87 | 38.70 | −45.77 | 632.87 | −1.56 | −1.39 | 632.87 |
| −34.25 | 47.38 | 632.87 | 38.91 | −46.02 | 632.87 | 2.75 | −6.82 | 632.87 |
| −33.92 | 46.96 | 632.87 | 39.10 | −46.26 | 632.87 | 6.66 | −11.60 | 632.87 |
| −33.56 | 46.48 | 632.87 | 39.27 | −46.46 | 632.87 | 10.18 | −15.81 | 632.87 |
| −33.15 | 45.95 | 632.87 | 39.42 | −46.64 | 632.87 | 13.36 | −19.53 | 632.87 |
| −32.69 | 45.35 | 632.87 | 39.55 | −46.81 | 632.87 | 16.22 | −22.81 | 632.87 |
| −32.18 | 44.67 | 632.87 | 39.66 | −46.95 | 632.87 | 18.78 | −25.71 | 632.87 |
| −31.60 | 43.92 | 632.87 | 39.77 | −47.08 | 632.87 | 21.09 | −28.27 | 632.87 |
| −30.95 | 43.06 | 632.87 | 39.86 | −47.20 | 632.87 | 23.15 | −30.54 | 632.87 |
| −30.22 | 42.11 | 632.87 | 39.94 | −47.30 | 632.87 | 25.00 | −32.55 | 632.87 |
| −29.39 | 41.03 | 632.87 | 39.99 | −47.41 | 632.87 | 26.65 | −34.32 | 632.87 |
| −28.47 | 39.83 | 632.87 | 39.98 | −47.51 | 632.87 | 28.13 | −35.90 | 632.87 |
| −27.43 | 38.47 | 632.87 | 39.89 | −47.65 | 632.87 | 29.46 | −37.30 | 632.87 |
| −26.26 | 36.95 | 632.87 | −36.61 | 49.80 | 632.87 | 30.64 | −38.54 | 632.87 |
| −24.95 | 35.24 | 632.87 | −36.60 | 49.70 | 632.87 | 31.69 | −39.64 | 632.87 |
| −23.47 | 33.32 | 632.87 | −36.57 | 49.58 | 632.87 | 32.63 | −40.61 | 632.87 |
| −21.81 | 31.16 | 632.87 | −36.51 | 49.46 | 632.87 | 33.47 | −41.48 | 632.87 |
| −19.94 | 28.74 | 632.87 | −36.44 | 49.33 | 632.87 | 34.22 | −42.25 | 632.87 |
| −17.84 | 26.02 | 632.87 | −36.35 | 49.19 | 632.87 | 34.89 | −42.93 | 632.87 |
| −15.48 | 22.96 | 632.87 | −36.25 | 49.03 | 632.87 | 35.49 | −43.54 | 632.87 |
| −12.83 | 19.53 | 632.87 | −36.14 | 48.86 | 632.87 | 36.02 | −44.08 | 632.87 |
| −9.84 | 15.68 | 632.87 | −36.02 | 48.65 | 632.87 | 36.49 | −44.56 | 632.87 |
| −6.47 | 11.35 | 632.87 | −35.88 | 48.43 | 632.87 | 36.91 | −44.99 | 632.87 |
| −2.69 | 6.50 | 632.87 | −35.73 | 48.17 | 632.87 | 37.29 | −45.37 | 632.87 |
| 1.57 | 1.05 | 632.87 | −35.56 | 47.89 | 632.87 | 37.63 | −45.70 | 632.87 |
| 5.83 | −4.39 | 632.87 | −35.36 | 47.57 | 632.87 | 37.92 | −46.00 | 632.87 |
| 9.63 | −9.22 | 632.87 | −35.14 | 47.20 | 632.87 | 38.19 | −46.27 | 632.87 |
| 13.02 | −13.51 | 632.87 | −34.90 | 46.80 | 632.87 | 38.43 | −46.51 | 632.87 |
| 16.04 | −17.33 | 632.87 | −34.62 | 46.34 | 632.87 | 38.64 | −46.72 | 632.87 |
| 18.73 | −20.73 | 632.87 | −34.31 | 45.83 | 632.87 | 38.82 | −46.91 | 632.87 |
| 21.13 | −23.75 | 632.87 | −33.96 | 45.26 | 632.87 | 38.99 | −47.07 | 632.87 |
| 23.26 | −26.44 | 632.87 | −33.56 | 44.61 | 632.87 | 39.14 | −47.22 | 632.87 |
| 25.16 | −28.83 | 632.87 | −33.12 | 43.89 | 632.87 | 39.27 | −47.35 | 632.87 |
| 26.86 | −30.96 | 632.87 | −32.61 | 43.07 | 632.87 | 39.39 | −47.47 | 632.87 |
| 28.37 | −32.85 | 632.87 | −32.05 | 42.16 | 632.87 | 39.50 | −47.58 | 632.87 |
| 29.71 | −34.53 | 632.87 | −31.41 | 41.14 | 632.87 | 39.59 | −47.67 | 632.87 |
| 30.91 | −36.03 | 632.87 | −30.69 | 39.99 | 632.87 | 39.70 | −47.71 | 632.87 |

TABLE 1-continued

| X | Y | Z | X | Y | Z | X | Y | Z |
|---|---|---|---|---|---|---|---|---|
| | | | SECTION 15 Z = 642.93 | | | | | |
| −35.93 | 50.39 | 642.93 | 31.19 | −38.03 | 642.93 | −29.27 | 39.13 | 642.93 |
| −35.74 | 50.41 | 642.93 | 32.12 | −39.23 | 642.93 | −28.36 | 37.69 | 642.93 |
| −35.64 | 50.35 | 642.93 | 32.95 | −40.30 | 642.93 | −27.33 | 36.07 | 642.93 |
| −35.55 | 50.26 | 642.93 | 33.68 | −41.25 | 642.93 | −26.17 | 34.25 | 642.93 |
| −35.46 | 50.14 | 642.93 | 34.34 | −42.09 | 642.93 | −24.85 | 32.21 | 642.93 |
| −35.36 | 50.00 | 642.93 | 34.92 | −42.85 | 642.93 | −23.36 | 29.93 | 642.93 |
| −35.25 | 49.85 | 642.93 | 35.44 | −43.52 | 642.93 | −21.68 | 27.38 | 642.93 |
| −35.13 | 49.68 | 642.93 | 35.90 | −44.11 | 642.93 | −19.77 | 24.52 | 642.93 |
| −34.99 | 49.49 | 642.93 | 36.32 | −44.65 | 642.93 | −17.60 | 21.32 | 642.93 |
| −34.83 | 49.28 | 642.93 | 36.68 | −45.12 | 642.93 | −15.13 | 17.75 | 642.93 |
| −34.66 | 49.04 | 642.93 | 37.01 | −45.54 | 642.93 | −12.33 | 13.75 | 642.93 |
| −34.46 | 48.77 | 642.93 | 37.30 | −45.91 | 642.93 | −9.15 | 9.29 | 642.93 |
| −34.24 | 48.47 | 642.93 | 37.56 | −46.24 | 642.93 | −5.51 | 4.32 | 642.93 |
| −33.99 | 48.13 | 642.93 | 37.79 | −46.54 | 642.93 | −1.36 | −1.21 | 642.93 |
| −33.70 | 47.75 | 642.93 | 38.00 | −46.80 | 642.93 | 2.86 | −6.71 | 642.93 |
| −33.39 | 47.32 | 642.93 | 38.18 | −47.04 | 642.93 | 6.68 | −11.55 | 642.93 |
| −33.03 | 46.84 | 642.93 | 38.34 | −47.24 | 642.93 | 10.12 | −15.83 | 642.93 |
| −32.63 | 46.30 | 642.93 | 38.49 | −47.43 | 642.93 | 13.22 | −19.60 | 642.93 |
| −32.18 | 45.69 | 642.93 | 38.62 | −47.59 | 642.93 | 16.00 | −22.94 | 642.93 |
| −31.68 | 45.01 | 642.93 | 38.73 | −47.74 | 642.93 | 18.50 | −25.90 | 642.93 |
| −31.11 | 44.24 | 642.93 | 38.84 | −47.87 | 642.93 | 20.74 | −28.51 | 642.93 |
| −30.47 | 43.38 | 642.93 | 38.93 | −47.99 | 642.93 | 22.75 | −30.83 | 642.93 |
| −29.76 | 42.41 | 642.93 | 39.01 | −48.09 | 642.93 | 24.54 | −32.88 | 642.93 |
| −28.95 | 41.32 | 642.93 | 39.06 | −48.19 | 642.93 | 26.15 | −34.70 | 642.93 |
| −28.05 | 40.10 | 642.93 | 39.07 | −48.29 | 642.93 | 27.59 | −36.31 | 642.93 |
| −27.03 | 38.73 | 642.93 | 38.97 | −48.44 | 642.93 | 28.87 | −37.75 | 642.93 |
| −25.88 | 37.19 | 642.93 | −35.99 | 50.23 | 642.93 | 30.01 | −39.02 | 642.93 |
| −24.60 | 35.46 | 642.93 | −35.98 | 50.13 | 642.93 | 31.04 | −40.15 | 642.93 |
| −23.15 | 33.51 | 642.93 | −35.94 | 50.02 | 642.93 | 31.95 | −41.15 | 642.93 |
| −21.53 | 31.33 | 642.93 | −35.88 | 49.90 | 642.93 | 32.76 | −42.04 | 642.93 |
| −19.70 | 28.88 | 642.93 | −35.80 | 49.77 | 642.93 | 33.49 | −42.83 | 642.93 |
| −17.64 | 26.12 | 642.93 | −35.71 | 49.63 | 642.93 | 34.14 | −43.53 | 642.93 |
| −15.33 | 23.03 | 642.93 | −35.62 | 49.47 | 642.93 | 34.71 | −44.16 | 642.93 |
| −12.72 | 19.55 | 642.93 | −35.51 | 49.29 | 642.93 | 35.23 | −44.71 | 642.93 |
| −9.80 | 15.66 | 642.93 | −35.39 | 49.09 | 642.93 | 35.69 | −45.21 | 642.93 |
| −6.50 | 11.28 | 642.93 | −35.25 | 48.87 | 642.93 | 36.09 | −45.65 | 642.93 |
| −2.79 | 6.37 | 642.93 | −35.09 | 48.61 | 642.93 | 36.46 | −46.04 | 642.93 |
| 1.38 | 0.85 | 642.93 | −34.92 | 48.32 | 642.93 | 36.78 | −46.38 | 642.93 |
| 5.56 | −4.65 | 642.93 | −34.73 | 48.00 | 642.93 | 37.07 | −46.69 | 642.93 |
| 9.29 | −9.54 | 642.93 | −34.51 | 47.64 | 642.93 | 37.33 | −46.97 | 642.93 |
| 12.61 | −13.89 | 642.93 | −34.27 | 47.23 | 642.93 | 37.56 | −47.21 | 642.93 |
| 15.57 | −17.75 | 642.93 | −33.99 | 46.78 | 642.93 | 37.76 | −47.43 | 642.93 |
| 18.21 | −21.19 | 642.93 | −33.68 | 46.27 | 642.93 | 37.94 | −47.62 | 642.93 |
| 20.56 | −24.25 | 642.93 | −33.33 | 45.69 | 642.93 | 38.11 | −47.79 | 642.93 |
| 22.65 | −26.97 | 642.93 | −32.94 | 45.05 | 642.93 | 38.25 | −47.95 | 642.93 |
| 24.52 | −29.39 | 642.93 | −32.49 | 44.32 | 642.93 | 38.38 | −48.08 | 642.93 |
| 26.18 | −31.54 | 642.93 | −31.99 | 43.51 | 642.93 | 38.49 | −48.20 | 642.93 |
| 27.66 | −33.46 | 642.93 | −31.43 | 42.60 | 642.93 | 38.59 | −48.31 | 642.93 |
| 28.97 | −35.16 | 642.93 | −30.79 | 41.57 | 642.93 | 38.68 | −48.41 | 642.93 |
| 30.15 | −36.68 | 642.93 | −30.08 | 40.42 | 642.93 | 38.78 | −48.47 | 642.93 |
| | | | SECTION 16 Z = 648.01 | | | | | |
| −35.63 | 50.61 | 648.01 | 30.80 | −38.36 | 648.01 | −28.97 | 39.35 | 648.01 |
| −35.44 | 50.62 | 648.01 | 31.72 | −39.57 | 648.01 | −28.06 | 37.90 | 648.01 |
| −35.34 | 50.55 | 648.01 | 32.53 | −40.65 | 648.01 | −27.03 | 36.28 | 648.01 |
| −35.25 | 50.46 | 648.01 | 33.26 | −41.60 | 648.01 | −25.87 | 34.46 | 648.01 |
| −35.17 | 50.34 | 648.01 | 33.91 | −42.46 | 648.01 | −24.56 | 32.42 | 648.01 |
| −35.07 | 50.20 | 648.01 | 34.49 | −43.21 | 648.01 | −23.08 | 30.13 | 648.01 |
| −34.96 | 50.05 | 648.01 | 35.00 | −43.89 | 648.01 | −21.40 | 27.57 | 648.01 |
| −34.84 | 49.88 | 648.01 | 35.46 | −44.49 | 648.01 | −19.50 | 24.71 | 648.01 |
| −34.70 | 49.69 | 648.01 | 35.87 | −45.02 | 648.01 | −17.35 | 21.50 | 648.01 |
| −34.55 | 49.47 | 648.01 | 36.23 | −45.50 | 648.01 | −14.91 | 17.92 | 648.01 |
| −34.38 | 49.23 | 648.01 | 36.55 | −45.92 | 648.01 | −12.13 | 13.91 | 648.01 |
| −34.18 | 48.96 | 648.01 | 36.84 | −46.30 | 648.01 | −8.97 | 9.43 | 648.01 |
| −33.96 | 48.66 | 648.01 | 37.10 | −46.63 | 648.01 | −5.36 | 4.44 | 648.01 |
| −33.71 | 48.32 | 648.01 | 37.33 | −46.93 | 648.01 | −1.26 | −1.13 | 648.01 |
| −33.43 | 47.93 | 648.01 | 37.53 | −47.19 | 648.01 | 2.92 | −6.65 | 648.01 |
| −33.12 | 47.50 | 648.01 | 37.71 | −47.43 | 648.01 | 6.70 | −11.53 | 648.01 |
| −32.77 | 47.02 | 648.01 | 37.87 | −47.64 | 648.01 | 10.09 | −15.84 | 648.01 |
| −32.37 | 46.47 | 648.01 | 38.02 | −47.82 | 648.01 | 13.15 | −19.65 | 648.01 |
| −31.93 | 45.86 | 648.01 | 38.15 | −47.99 | 648.01 | 15.90 | −23.01 | 648.01 |
| −31.43 | 45.18 | 648.01 | 38.26 | −48.14 | 648.01 | 18.36 | −26.00 | 648.01 |
| −30.87 | 44.40 | 648.01 | 38.36 | −48.27 | 648.01 | 20.57 | −28.64 | 648.01 |
| −30.24 | 43.54 | 648.01 | 38.45 | −48.38 | 648.01 | 22.55 | −30.98 | 648.01 |
| −29.53 | 42.56 | 648.01 | 38.53 | −48.49 | 648.01 | 24.32 | −33.05 | 648.01 |
| −28.73 | 41.47 | 648.01 | 38.59 | −48.59 | 648.01 | 25.90 | −34.89 | 648.01 |

TABLE 1-continued

| X | Y | Z | X | Y | Z | X | Y | Z |
|---|---|---|---|---|---|---|---|---|
| −27.84 | 40.24 | 648.01 | 38.60 | −48.69 | 648.01 | 27.31 | −36.53 | 648.01 |
| −26.83 | 38.86 | 648.01 | 38.51 | −48.83 | 648.01 | 28.57 | −37.98 | 648.01 |
| −25.70 | 37.31 | 648.01 | −35.68 | 50.45 | 648.01 | 29.70 | −39.26 | 648.01 |
| −24.42 | 35.57 | 648.01 | −35.66 | 50.34 | 648.01 | 30.71 | −40.41 | 648.01 |
| −22.99 | 33.61 | 648.01 | −35.62 | 50.23 | 648.01 | 31.61 | −41.42 | 648.01 |
| −21.38 | 31.41 | 648.01 | −35.55 | 50.12 | 648.01 | 32.41 | −42.32 | 648.01 |
| −19.57 | 28.95 | 648.01 | −35.48 | 49.99 | 648.01 | 33.12 | −43.13 | 648.01 |
| −17.54 | 26.18 | 648.01 | −35.39 | 49.85 | 648.01 | 33.76 | −43.84 | 648.01 |
| −15.25 | 23.06 | 648.01 | −35.30 | 49.69 | 648.01 | 34.32 | −44.47 | 648.01 |
| −12.68 | 19.57 | 648.01 | −35.19 | 49.51 | 648.01 | 34.83 | −45.04 | 648.01 |
| −9.78 | 15.65 | 648.01 | −35.06 | 49.31 | 648.01 | 35.28 | −45.54 | 648.01 |
| −6.52 | 11.24 | 648.01 | −34.93 | 49.08 | 648.01 | 35.68 | −45.98 | 648.01 |
| −2.85 | 6.30 | 648.01 | −34.77 | 48.83 | 648.01 | 36.04 | −46.38 | 648.01 |
| 1.29 | 0.75 | 648.01 | −34.60 | 48.54 | 648.01 | 36.36 | −46.73 | 648.01 |
| 5.42 | −4.78 | 648.01 | −34.41 | 48.22 | 648.01 | 36.64 | −47.04 | 648.01 |
| 9.11 | −9.70 | 648.01 | −34.19 | 47.86 | 648.01 | 36.90 | −47.32 | 648.01 |
| 12.40 | −14.07 | 648.01 | −33.95 | 47.45 | 648.01 | 37.12 | −47.57 | 648.01 |
| 15.33 | −17.96 | 648.01 | −33.67 | 47.00 | 648.01 | 37.32 | −47.79 | 648.01 |
| 17.94 | −21.42 | 648.01 | −33.36 | 46.48 | 648.01 | 37.50 | −47.98 | 648.01 |
| 20.27 | −24.50 | 648.01 | −33.01 | 45.91 | 648.01 | 37.66 | −48.16 | 648.01 |
| 22.34 | −27.24 | 648.01 | −32.62 | 45.26 | 648.01 | 37.80 | −48.31 | 648.01 |
| 24.19 | −29.67 | 648.01 | −32.18 | 44.54 | 648.01 | 37.93 | −48.45 | 648.01 |
| 25.83 | −31.84 | 648.01 | −31.68 | 43.72 | 648.01 | 38.04 | −48.57 | 648.01 |
| 27.30 | −33.76 | 648.01 | −31.12 | 42.81 | 648.01 | 38.14 | −48.68 | 648.01 |
| 28.60 | −35.48 | 648.01 | −30.48 | 41.79 | 648.01 | 38.23 | −48.78 | 648.01 |
| 29.76 | −37.01 | 648.01 | −29.77 | 40.64 | 648.01 | 38.32 | −48.85 | 648.01 |

According to embodiments of the invention, by manufacturing a rotor blade 102 in accordance with the Table 1 of points set forth above, the thickness of the rotor blade 102 changes continuously along the blade height in order to, for example, move a resonance frequency associated with movement of the rotor blade 102 to, for example, improve a design margin associated with fatigue. This change in thickness can be seen, for example, in the plot of FIG. 5. Therein, in a first region closest to the rotor blade's platform 200, starting from about 2.21% of the blade height (i.e., just above the blade fillet radius) up to about 60% of the blade height, the maximum thickness of the rotor blade 102 according to this embodiment of the invention can be described by the following linear function:

$$T\max=-0.8646*h+1.1087 \text{ (where h is blade height percentage)}$$

In the subsequent region, ranging from 60% to 80% of the rotor blade height, the maximum thickness of the rotor blade 102 varies according to the following linear function:

$$T\max=-1.0209*h+1.2058 \text{ (where h is blade height percentage)}$$

In the subsequent region, ranging from 80% to 100% of blade height (i.e., to free end of the blade), the maximum thickness of the rotor blade 102 varies according to the following linear function:

$$T\max=-0.7618*h+0.9985 \text{ (where h is blade height percentage)}$$

Figure 5:
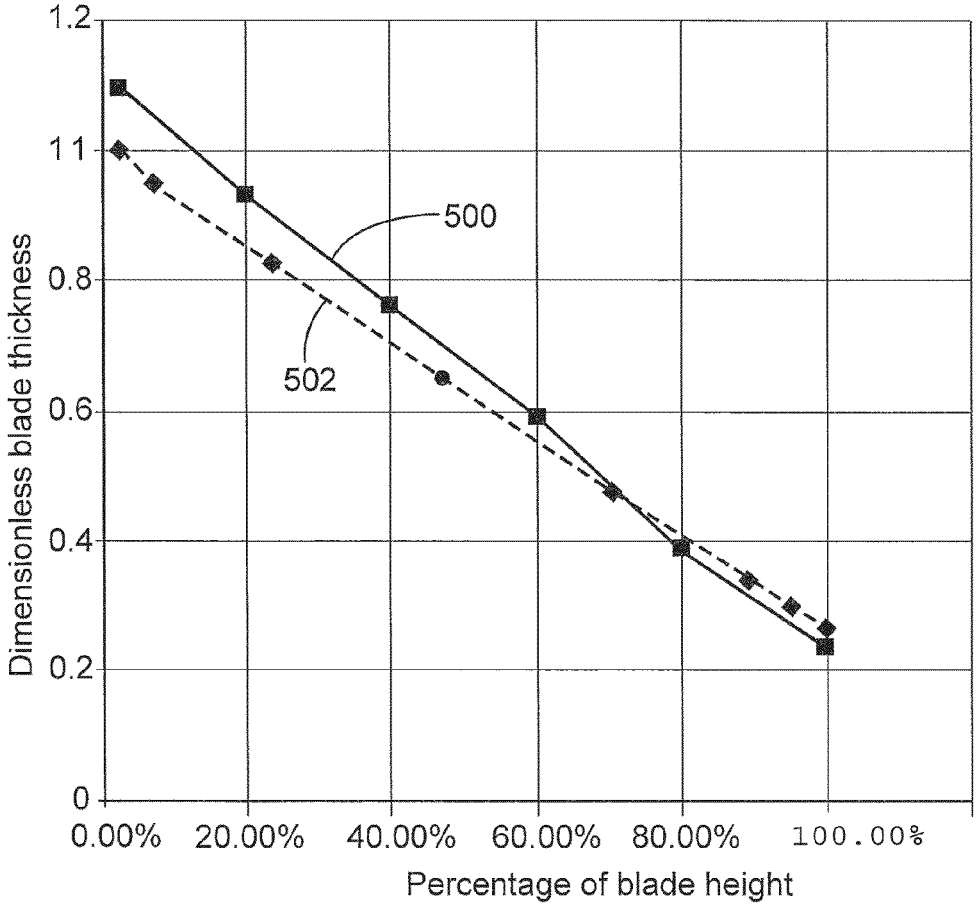
FIG. 5 is a graph depicting blade thickness as a function of blade height according to an embodiment of the invention.

Thus, it can be seen in the plot of FIG. 5, wherein function 500 depicts rotor blade thickness as a function of blade height for an embodiment of the invention and function 502 depicts the same quantity for a baseline design, that embodiments of the invention provide for a thicker rotor blade through about the first 75% of the blade height (where the functions cross) and then for a thinner rotor blade relative to the baseline design. It will be appreciated that, however, these exemplary functions are purely illustrative and that some variance in the points set forth in Table 1 are to be expected as will be described below.

It will be appreciated by those skilled in the art that Table 1 provides sufficient data to completely define the shape of an airfoil 204 according to embodiments of the invention. For example, by defining X and Y coordinate values at selected locations in a Z direction normal to the X, Y plane, the profile section of the rotor blade airfoil 204 at each Z distance along the length of the airfoil can be ascertained. By connecting the X and Y values with smooth continuing arcs, each profile section of the airfoil 204 at each distance Z can be fixed. The airfoil profiles of the various surface locations between the distances Z are determined by smoothly connecting the adjacent profile sections to one another, thus forming the airfoil 204's profile. The values set forth above in Table 1 represent the airfoil profiles according to embodiments of the invention at ambient, non-operating or non-hot conditions and are for an uncoated airfoil.

The table values provided in Table 1 are generated and shown to two decimal places for determining the profile of the airfoil 204. There are typical manufacturing tolerances as well as coatings, which should be accounted for in the actual profile of the airfoil. Accordingly, it will be appreciated by those skilled in the art that the values for the profile given in Table 1 are for a nominal airfoil 204. It will therefore be appreciated that the actual values encompassed by these embodiments of the invention are not limited to the precise values shown in Table 1, but are instead intended to include a range of values around those specified in the table.

For example, the values encompassed should be plus or minus typical manufacturing tolerances, and/or plus or minus any coating thicknesses used on the airfoil 204. Therefore, a distance of about +/−1.0 mm in a direction normal to any surface location along the airfoil profile defines an airfoil profile envelope for a rotor blade airfoil design and compressor according to these embodiments of the invention. In other words, a distance of about +/−1.0 mm, and preferably about +/−0.5 mm, in a direction normal to any surface location along the airfoil profile defines a range of variation between measured points on the actual airfoil surface at nominal cold or room temperature and the ideal position of those points, at the same temperature, according to exemplary embodiments of the invention.

Moreover it will be appreciated by those skilled in the art that the shape of the airfoils 204 according to these embodiments of the invention will also vary from their cold or room temperature manufactured shape, to their heated shape when placed into operation in a gas turbine engine. As the airfoils 204 heat up in service, stress and temperature will cause a change in the X, Y, Z values of the cold or room temperature points depicted in Table 1. Thus embodiments of the invention further contemplate the inclusion of variances associated with heating of the airfoils 204 during normal operation.

The airfoil, according to embodiments of the invention, can find application as a first stage rotor shape. The coordinate values for the X, Y and Z coordinates are set forth in millimeters, although other units of dimensions may be used when the values are appropriately converted. These values exclude fillet regions of the platform.

The above-described embodiments of the invention are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims. No element, act, or instruction used in the description of the present application should be construed as critical or essential to the invention unless explicitly described as such. Also, as used herein, the article "a" is intended to include one or more items.

What is claimed is:

1. A rotor blade comprising a nominal surface profile substantially in accordance with Cartesian coordinates X, Y and Z as set forth in TABLE 1, wherein X and Y are distances in millimeters which, when connected by smooth, continuing arcs, define airfoil profile sections at each distance Z in millimeters, and wherein the airfoil profile sections at the Z distances are joined smoothly with one another to form a complete airfoil shape.

2. The rotor blade of claim 1, wherein the nominal surface profile substantially in accordance with Cartesian coordinates X, Y and Z as set forth in TABLE 1 includes points within +/−1 mm in a direction normal to any surface of the complete airfoil shape.

3. The rotor blade of claim 1, wherein a maximum thickness (Tmax) of the rotor blade starting from about 2.21% of a blade height up to about 60% of rotor blade height, is described by:

$$T\max=-0.8646*h+1.1087,$$ where h is blade height percentage.

4. The rotor blade of claim 3, wherein the maximum thickness of the rotor blade in a first subsequent region, ranging from about 60% to about 80% of the rotor blade height, is described by:

$$T\max=-1.0209*h+1.2058,$$ where h is blade height percentage.

5. The rotor blade of claim 3, wherein the maximum thickness of the rotor blade in a second subsequent region, ranging from 80% to 100% of the rotor blade height, is described by:

$$T\max=-0.7618*h+0.9985,$$ where h is blade height percentage.

6. A rotor blade comprising:

a platform;

a root portion of the rotor blade connected to the platform; and a blade surface ending in a tip portion, the blade surface comprising a cross-sectional airfoil shape, wherein a thickness of the rotor blade varies as a function of rotor blade height in accordance with three different linear functions, and wherein a maximum thickness (Tmax) of the rotor blade starting from about 2.21% of a blade height up to about 60% of rotor blade height, is described by a first one of the three linear functions as:

$$T\max=-0.8646*h+1.1087,$$ where h is blade height percentage).

7. The rotor blade of claim 6, wherein the rotor blade has a nominal surface profile substantially in accordance with Cartesian coordinates X, Y and Z as set forth in TABLE 1, wherein X and Y are distances in millimeters which, when connected by smooth, continuing arcs, define airfoil profile sections at each distance Z in millimeters, and wherein the airfoil profile sections at the Z distances are joined smoothly with one another to form a complete airfoil shape.

8. The rotor blade of claim 7, wherein the nominal surface profile substantially in accordance with Cartesian coordinates X, Y and Z as set forth in TABLE 1 includes points within +/−1 mm in a direction normal to any surface of the complete airfoil shape.

9. A rotor blade comprising:

a platform;

a root portion of the rotor blade connected to the platform; and a blade surface ending in a tip portion, the blade surface comprising a cross-sectional airfoil shape, wherein a thickness of the rotor blade varies as a function of rotor blade height in accordance with three different linear functions, and wherein the maximum thickness of the rotor blade in a first subsequent region, ranging from about 60% to about 80% of the rotor blade height, is described by a second one of the three linear functions as:

$$T\max=-1.0209*h+1.2058,$$ where h is blade height percentage.

10. The rotor blade of claim 9, wherein the rotor blade has a nominal surface profile substantially in accordance with Cartesian coordinates X, Y and Z as set forth in TABLE 1, wherein X and Y are distances in millimeters which, when connected by smooth, continuing arcs, define airfoil profile sections at each distance Z in millimeters, and wherein the airfoil profile sections at the Z distances are joined smoothly with one another to form a complete airfoil shape.

11. The rotor blade of claim 10, wherein the nominal surface profile substantially in accordance with Cartesian coordinates X, Y and Z as set forth in TABLE 1 includes points within +/−1 mm in a direction normal to any surface of the complete airfoil shape.

12. A rotor blade comprising:

a platform;

a root portion of the rotor blade connected to the platform; and a blade surface ending in a tip portion, the blade surface comprising a cross-sectional airfoil shape, wherein a thickness of the rotor blade varies as a function of rotor blade height in accordance with three different linear functions, and wherein the maximum thickness of the rotor blade in a second subsequent region, ranging from 80% to 100% of the rotor blade height, is described by a third one of the three linear functions as:

$$T\max=-0.7618*h+0.9985,$$ where h is blade height percentage.

13. The rotor blade of claim 12, wherein the rotor blade has a nominal surface profile substantially in accordance with Cartesian coordinates X, Y and Z as set forth in TABLE 1, wherein X and Y are distances in millimeters which, when connected by smooth, continuing arcs, define airfoil profile sections at each distance Z in millimeters, and wherein the airfoil profile sections at the Z distances are joined smoothly with one another to form a complete airfoil shape.

14. The rotor blade of claim 13, wherein the nominal surface profile substantially in accordance with Cartesian coordinates X, Y and Z as set forth in TABLE 1 includes points within +/−1 mm in a direction normal to any surface of the complete airfoil shape.

* * * * *